US006676807B2

(12) United States Patent
Hada et al.

(10) Patent No.: US 6,676,807 B2
(45) Date of Patent: Jan. 13, 2004

(54) SYSTEM AND PROCESS FOR REDUCING THE CALIPER OF PAPER WEBS

(75) Inventors: Frank S. Hada, Appleton, WI (US); Keith D. Glass, Appleton, WI (US); Ronald F. Gropp, St. Catharines (CA); Patricia Riedl, Borgomanero (IT); Douglas C. Thomas, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 154 days.

(21) Appl. No.: 09/992,489

(22) Filed: Nov. 5, 2001

(65) Prior Publication Data

US 2003/0085014 A1 May 8, 2003

(51) Int. Cl.[7] ..... D21F 11/14; D21F 25/00; D21G 1/00

(52) U.S. Cl. ..... 162/205; 162/123; 162/204; 162/361; 100/153; 100/162 R

(58) Field of Search ..... 162/204–207, 162/361, 358.1, 358.3, 360.2, 123; 100/35, 302, 137, 162 R, 193, 153, 144, 161

(56) References Cited

U.S. PATENT DOCUMENTS

| | | | | |
|---|---|---|---|---|
| 1,766,944 A | * | 6/1930 | Rawling | 162/181.2 |
| 3,492,200 A | * | 1/1970 | McKie et al. | 162/348 |
| 3,792,656 A | * | 2/1974 | Heissenberger | 100/118 |
| 3,796,149 A | * | 3/1974 | Heissenberger | 100/118 |
| 3,879,257 A | | 4/1975 | Gentile et al. | |
| 3,903,342 A | | 9/1975 | Roberts, Jr. | |
| 3,906,853 A | | 9/1975 | Wohlfarter | |
| 4,166,001 A | | 8/1979 | Dunning et al. | |
| 4,225,382 A | | 9/1980 | Kearney et al. | |
| 4,344,818 A | | 8/1982 | Nuttall et al. | |
| 5,562,805 A | | 10/1996 | Kamps et al. | |
| 5,656,132 A | | 8/1997 | Farrington, Jr. et al. | |
| 5,672,248 A | | 9/1997 | Wendt et al. | |

(List continued on next page.)

FOREIGN PATENT DOCUMENTS

| | | |
|---|---|---|
| CA | 2241820 | 2/1999 |
| EP | 0618329 B1 | 8/1999 |
| EP | 0675225 B1 | 2/2000 |
| WO | WO 9513424 | 5/1995 |
| WO | WO 0008253 A1 | 2/2000 |

OTHER PUBLICATIONS

U.S. patent application Ser. No. 09/854,145, filed May 11, 2001, Drew et al., Process For Increasing The Softness Of Base Webs And Products Made Therefrom.

U.S. patent application Ser. No. 09/997,405, filed Nov. 29, 2001, Bakken et al., Process For Increasing The Softness Of Base Webs And Products Made Therefrom.

U.S. application Ser. No. 10/013,337, filed Dec. 10, 2001, Hada et al., Process For Increasing The Softness Of Base Webs And Products Made Therefrom.

PCT Search Report, Nov. 21, 2002.

*Primary Examiner*—Jose A. Fortuna
(74) *Attorney, Agent, or Firm*—Dority & Manning

(57) ABSTRACT

A process for increasing the tactile properties of a base web without adversely affecting the strength of the web is disclosed. In general, the process includes the steps of placing a base web in between a first moving conveyor and a second moving conveyor. The conveyors are then wrapped around a shear inducing roll which creates shear forces that act upon the base web. The shear inducing roll typically has a relatively small diameter. In some applications, more than one shear inducing roll may be incorporated into the system. In other applications, the shear inducing roll can also be a nip roll for decreasing the caliper of the base web. The shear inducing roll may be stationary, as in the form of a stationary shoe with a convex edge, or may rotate. In one embodiment, the shear inducing roll can rotate on an air bearing.

26 Claims, 16 Drawing Sheets

U.S. PATENT DOCUMENTS

| | | | | |
|---|---|---|---|---|
| 5,695,607 | A | | 12/1997 | Oriaran et al. |
| 5,851,629 | A | | 12/1998 | Oriaran et al. |
| 5,882,479 | A | | 3/1999 | Oriaran et al. |
| 5,932,068 | A | | 8/1999 | Farrington, Jr. et al. |
| 5,958,185 | A | | 9/1999 | Vinson et al. |
| 6,017,418 | A | | 1/2000 | Oriaran et al. |
| 6,033,523 | A | | 3/2000 | Dwiggins et al. |
| 6,033,761 | A | | 3/2000 | Dwiggins et al. |
| 6,051,104 | A | | 4/2000 | Oriaran et al. |
| 6,068,731 | A | | 5/2000 | Dwiggins et al. |
| 6,096,169 | A | | 8/2000 | Hermans et al. |
| 6,103,063 | A | | 8/2000 | Oriaran et al. |
| 6,113,740 | A | | 9/2000 | Oriaran et al. |
| 6,120,642 | A | | 9/2000 | Lindsay et al. |
| 6,143,131 | A | | 11/2000 | Dwiggins et al. |
| 6,143,135 | A | | 11/2000 | Hada et al. |
| 6,153,053 | A | | 11/2000 | Harper et al. |
| 6,183,601 | B1 | | 2/2001 | Otto et al. |
| 6,197,154 | B1 | | 3/2001 | Chen et al. |
| 2002/0088592 | A1 | * | 7/2002 | Drew et al. ..... 162/297 |
| 2002/0112830 | A1 | * | 8/2002 | Bakken et al. ..... 162/123 |
| 2002/0166646 | A1 | * | 11/2002 | Drew et al. ..... 162/111 |
| 2003/0000664 | A1 | * | 1/2003 | Drew et al. ..... 162/109 |

* cited by examiner

SYSTEM AND PROCESS FOR REDUCING THE CALIPER OF PAPER WEBS

BACKGROUND OF THE INVENTION

Products made from base webs such as bath tissues, facial tissues, paper towels, industrial wipers, food service wipers, napkins, medical pads, and other similar products are designed to include several important properties. For example, the products should have a soft feel and, for most applications, should be highly absorbent. The products should also have good stretch characteristics and should resist tearing. Further, the products should also have good strength characteristics, should be abrasion resistant, and should not deteriorate in the environment in which they are used.

In the past, many attempts have been made to enhance and increase certain physical properties of such products. Unfortunately, however, when steps are taken to increase one property of these products, other characteristics of the products may be adversely affected. For instance, the softness of nonwoven products, such as various paper products, can be increased by several different methods, such as by selecting a particular fiber type, or by reducing cellulosic fiber bonding within the product. Increasing softness according to one of the above methods, however, may adversely affect the strength of the product. Conversely, steps normally taken to increase the strength of a fibrous web typically have an adverse impact upon the softness, the stiffness or the absorbency of the web.

The present invention is directed to improvements in base webs and to improvements in processes for making the webs in a manner that optimizes the physical properties of the webs. In particular, the present invention is directed to a process for improving the tactile properties, such as softness and stiffness, of base webs without severely diminishing the strength of the webs. The present invention is also directed to a process for reducing the caliper of nonwoven webs.

SUMMARY OF THE INVENTION

As stated above, the present invention is directed to further improvements in prior art constructions and methods, which are achieved by providing a process for producing base webs, namely base webs containing pulp fibers. The process includes the step of first forming a base web. The base web can be made from various fibers and can be constructed in various ways. For instance, the base web can contain pulp fibers and/or staple fibers. Further, the base web can be formed in a wet lay process, an air forming process, or the like.

Once the base web is formed, the web is placed in between a first moving conveyor and a second moving conveyor. The first and second moving conveyors are then guided around a shear inducing roll while the base web is positioned in between the conveyors. The conveyors are sufficiently wrapped around the shear inducing roll and are placed under a sufficient amount of tension so as to create shear forces that act upon the base web. The shear forces disrupt the web increasing the softness and decreasing the stiffness of the web. Of particular advantage, it has been discovered that the softness of the web is increased without substantially reducing the strength of the web. More particularly, it has been discovered that the process shifts the normal strength-softness curve so as to create webs having unique softness and strength properties.

For some applications, it may be desirable to decrease the caliper of a web while still gaining all of the above advantages. For such a situation, it may be desirable to combine the shear inducing process with a calendering process. This system can provide additional caliper reduction of the web at nips formed using the shear inducing roll itself as a nip roll. The shear inducing roll can contact support rolls located on either side of the shear inducing roll. The conveyors can then wrap around the support roll, pass through the first nip, wrap around the shear inducing roll, and pass through the second nip before wrapping around the second support roll. In one particular embodiment, the conveyors can wrap around the shear inducing roll in an amount greater than 180°.

In one embodiment of a shear inducing/nip roll combination system, the shear inducing roll can be fixed in only the cross machine, or axial direction of the roll, and free to 'float' in other directions. This can allow the tension of the conveyors passing over the shear inducing roll to pull the shear inducing roll against the support rolls. In this manner, the tension placed on the conveyors can control the nip pressures. The axis of the shear inducing roll can be placed either above or below the plane defined by the axes of the support rolls, with the support rolls close enough to each other that the shear inducing roll cannot pass between them. In general, the support rolls can have diameters greater than the shear inducing roll, for example, greater than 20 inches, but they need not have diameters equal to each other.

The shear inducing roll can rotate or can be a stationary device. The shear inducing roll can have any diameter that permits the introduction of shear forces in the web. For example, the roll can have a diameter of up to 20 inches or larger. For most applications, however, the shear inducing roll can have a small effective diameter, such as less than about 10 inches, particularly less than about 7 inches and more particularly from about 2 inches to about 6 inches. For most applications, the conveyors should be wrapped around the shear inducing roll at least 40°, and particularly from about 80° to about 270°. Further, the amount of tension placed upon the conveyors when wrapped around the shear inducing roll should be at least 5 pounds per linear inch and particularly from about 10 pounds per linear inch to about 50 pounds per linear inch.

In one embodiment, the shear inducing roll can be supported by an air film on a bearing. The bearing can be on a stiff, stationary beam comprised of one or more gas chambers which provide air through the bearing to support the roll. If more than one chamber is in the beam, each chamber can be supplied by separately controlled pressure regulation in order to keep the shear inducing roll centered on the bearing. Such an embodiment can allow for a very small diameter shear inducing roll, such as less than ten inches, and can prevent deflection of the roll across the web due to the support of the bearing beneath the roll.

In another possible embodiment, the shear inducing roll can be in the form of a stiff, stationary shoe having a convex outer edge. In addition, the shoe can have an impermeable polymer belt surrounding it which can be free to rotate around the shoe. The conveyors can pass over the convex edge of the shoe while in contact with the rotating polymer belt. Such a system can allow for a small effective diameter for inducing shear, such as 10 inches or less, and also can prevent roll deflection across the shear inducing roll.

When guided around the shear inducing roll, the base web should have a moisture content of less than about 10%, particularly less than about 5% and more particularly less than about 2%.

As described above, various types of base webs can be processed according to the present invention. For example, in one embodiment, the base web can be a stratified web including a middle layer positioned between a first outer layer and a second outer layer. In one embodiment, the outer layers can have a tensile strength greater than the middle layer. For example, the outer layers can be made from softwood fibers, while the middle layer can be made from hardwood fibers.

Alternatively, the middle layer can have a tensile strength greater than the outer layers. It has been discovered by the present inventors that various unique products can be formed when using stratified base webs as described above.

Base webs processed according to the present invention can have various applications and uses. For instance, the webs can be used and incorporated into bath tissues, facial tissues, paper towels, industrial wipers, food service wipers, napkins, medical pads, diapers, feminine hygiene products, and other similar products.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
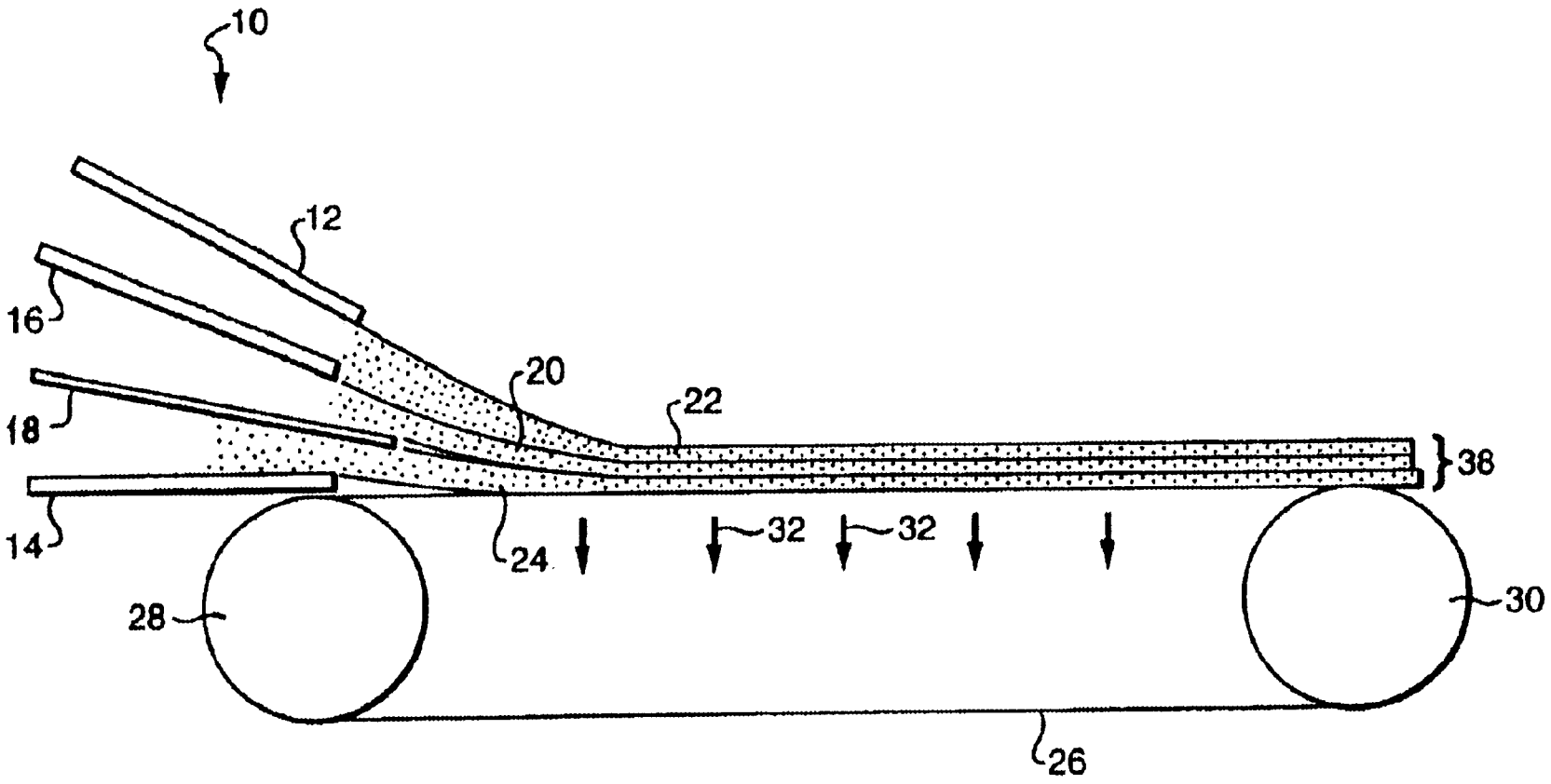
FIG. 1 is a schematic diagram of a fibrous web forming machine illustrating one embodiment for forming a base web having multiple layers in accordance with the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for improving the tactile properties of base webs without a subsequent substantial loss in tensile strength. The present invention is also directed to webs made from the process. In particular, the process of the present invention is well suited to increasing the softness and decreasing the stiffness of base webs, such as webs containing pulp fibers. Further, in some applications, the caliper of a web can be reduced while still gaining all of the above advantages.

Generally speaking, the process of the present invention includes the steps of placing a previously formed base web in between a pair of moving conveyors. As used herein, a conveyor is intended to refer to a flexible sheet, such as a wire, a fabric, a felt, and the like. Once the base web is placed in between the moving conveyors, the conveyors are guided around at least one shear inducing roll. The shear inducing roll can rotate or can be stationary and typically has a small effective diameter, such as less than about 10 inches.

The moving conveyors have a sufficient amount of wrap around the shear inducing roll and are placed under sufficient tension to create shear forces that act upon the base web. Specifically, passing the conveyors over the shear inducing roll causes a speed differential in the conveyors which creates a shearing force that breaks bonds within the web or otherwise disrupts fiber entanglement within the web, where the web is weakest. Through this process, the softness of the web increases while the stiffness of the web is reduced. Unexpectedly, the present inventors have discovered that this softening occurs with substantially less loss of tensile strength than would be expected at the softness levels obtained.

Base webs that may be used in the process of the present invention can vary depending upon the particular application. In general, any suitable base web may be used in the process in order to improve the tactile properties of the web. Further, the webs can be made from any suitable type of fiber.

For example, the manner in which the base web of the present invention is formed may vary depending upon the particular application. In one embodiment, the web can contain pulp fibers and can be formed in a wet lay process according to conventional paper making techniques. In a wet lay process, the fiber furnish is combined with water to form an aqueous suspension. The aqueous suspension is spread onto a wire or felt and dried to form the web.

Alternatively, the base web of the present invention can be air formed. In this embodiment, air is used to transport the fibers and form a web. Air forming processes are typically capable of processing longer fibers than most wet lay processes, which may provide an advantage in some applications.

Figure 2:
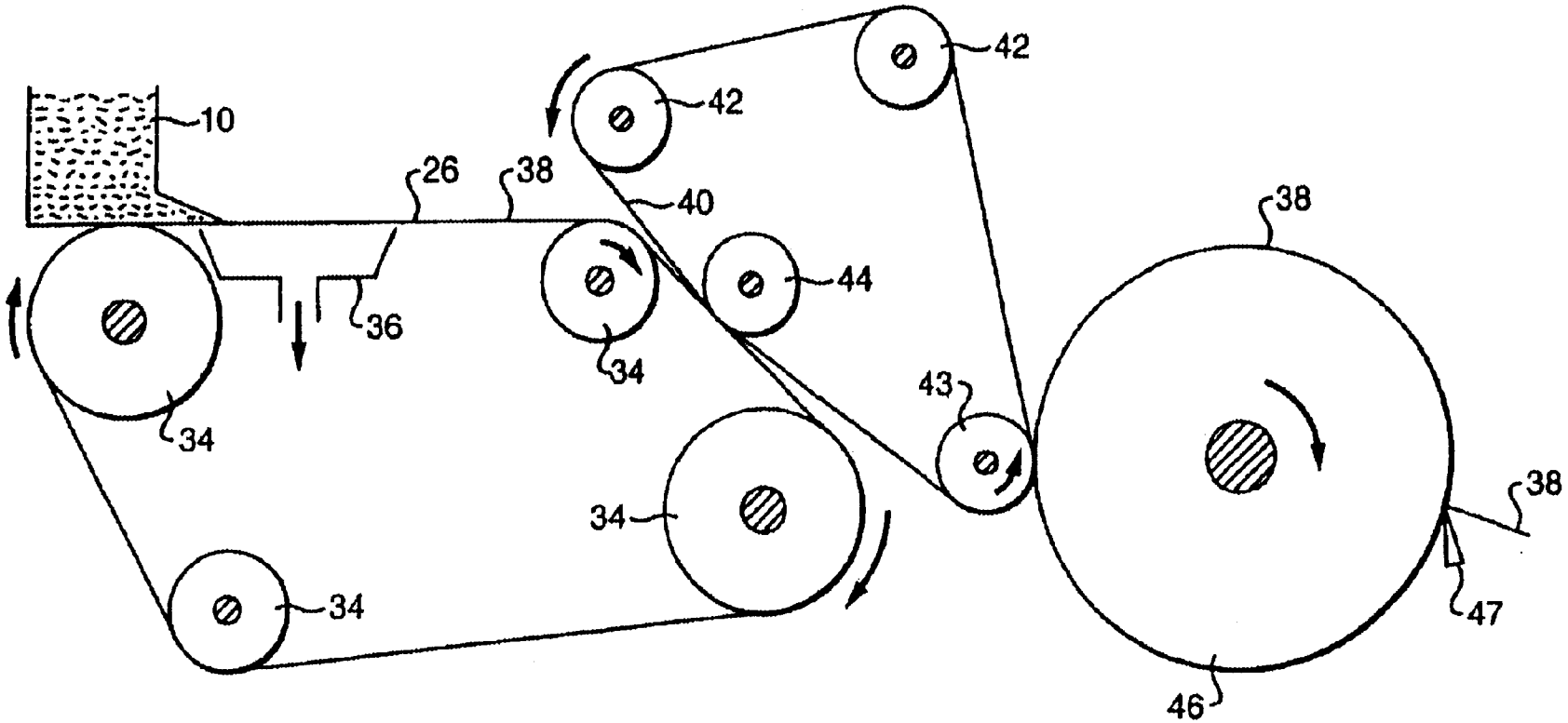
FIG. 2 is a schematic diagram of a fibrous web forming machine that crepes one side of the web.

Referring to FIG. 2, one embodiment of a process for producing a base web that may be used in accordance with the present invention is illustrated. The process illustrated in the figure depicts a wet lay process, although, as described above, other techniques for forming the base web of the present invention may be used.

As shown in FIG. 2, the web forming system includes a headbox 10 for receiving an aqueous suspension of fibers. Headbox 10 spreads the aqueous suspension of fibers onto a forming fabric 26 that is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. The speed at which fabric 40 can be driven is approximately the same speed at which fabric 26 is driven so that movement of web 38 through the system is consistent. Alternatively, the two fabrics can be run at different speeds, such as in a rush transfer process, in order to increase the bulk of the webs or for some other purpose.

From fabric 40, web 38, in this embodiment, is pressed onto the surface of a rotatable heated dryer drum 46, such as a Yankee dryer, by a press roll 43. Web 38 is lightly pressed into engagement with the surface of dryer drum 46 to which it adheres, due to its moisture content and its preference for the smoother of the two surfaces. As web 38 is carried through a portion of the rotational path of the dryer surface, heat is imparted to the web causing most of the moisture contained within the web to be evaporated.

Web 38 is then removed from dryer drum 46 by a creping blade 47. Creping web 38 as it is formed reduces internal bonding within the web and increases softness.

In an alternative embodiment, instead of wet pressing the base web 38 onto a dryer drum and creping the web, the web can be through air dried. A through air dryer accomplishes the removal of moisture from the base web by passing air through the web without applying any mechanical pressure.

Figure 3:
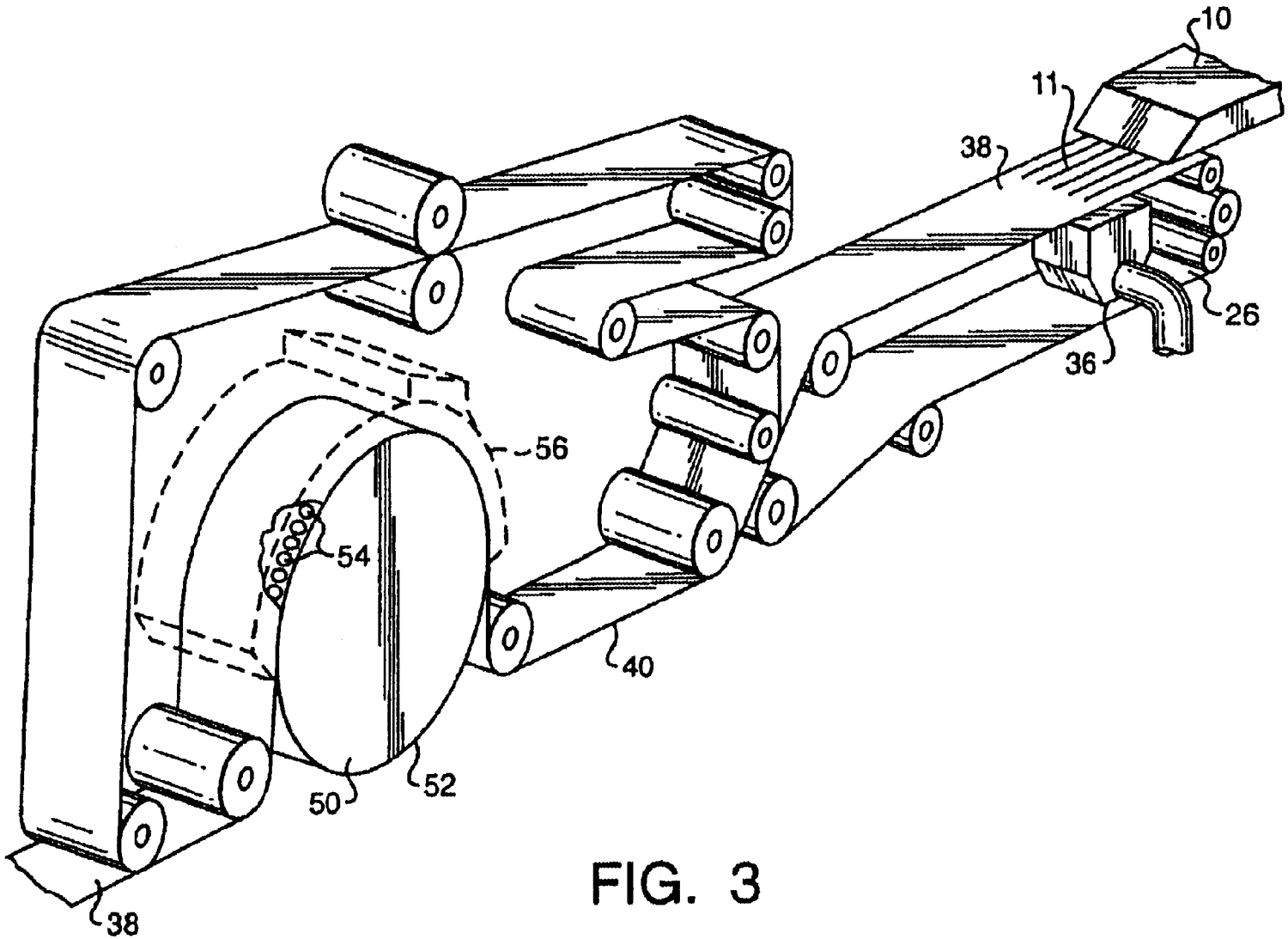
FIG. 3 is a perspective view with cut away portions of a fibrous web forming machine that includes a through air dryer for removing moisture from the web.

For example, referring to FIG. 3, an alternative embodiment for forming a base web for use in the process of the present invention containing a through air dryer is illustrated. As shown, a dilute aqueous suspension of fibers is supplied by a headbox 10 and deposited via a sluice 11 in uniform dispersion onto a forming fabric 26 in order to form a base web 38.

Once deposited onto the forming fabric 26, water is removed from the web 38 by combinations of gravity, centrifugal force and vacuum suction depending upon the forming configuration. As shown in this embodiment, and similar to FIG. 2, a vacuum box 36 can be disposed beneath the forming fabric 26 for removing water and facilitating formation of the web 38.

From the forming fabric 26, the base web 38 is then transferred to a second fabric 40. The second fabric 40 carries the web through a through air drying apparatus 50. The through air drying apparatus 50 dries the base web 38 without applying a compressive force in order to maximize bulk. For example, as shown in FIG. 3, the through air drying apparatus 50 includes an outer rotatable cylinder 52 with perforations 54 in combination with an outer hood 56. Specifically, the fabric 40 carries the web 38 over the upper portion of the through air dryer outer cylinder 52. Heated air is drawn through perforations 54 which contacts the web 38 and removes moisture. In one embodiment, the temperature of the heated air forced through the perforations 54 can be from about 170 F. to about 500 F.

Figure 4:
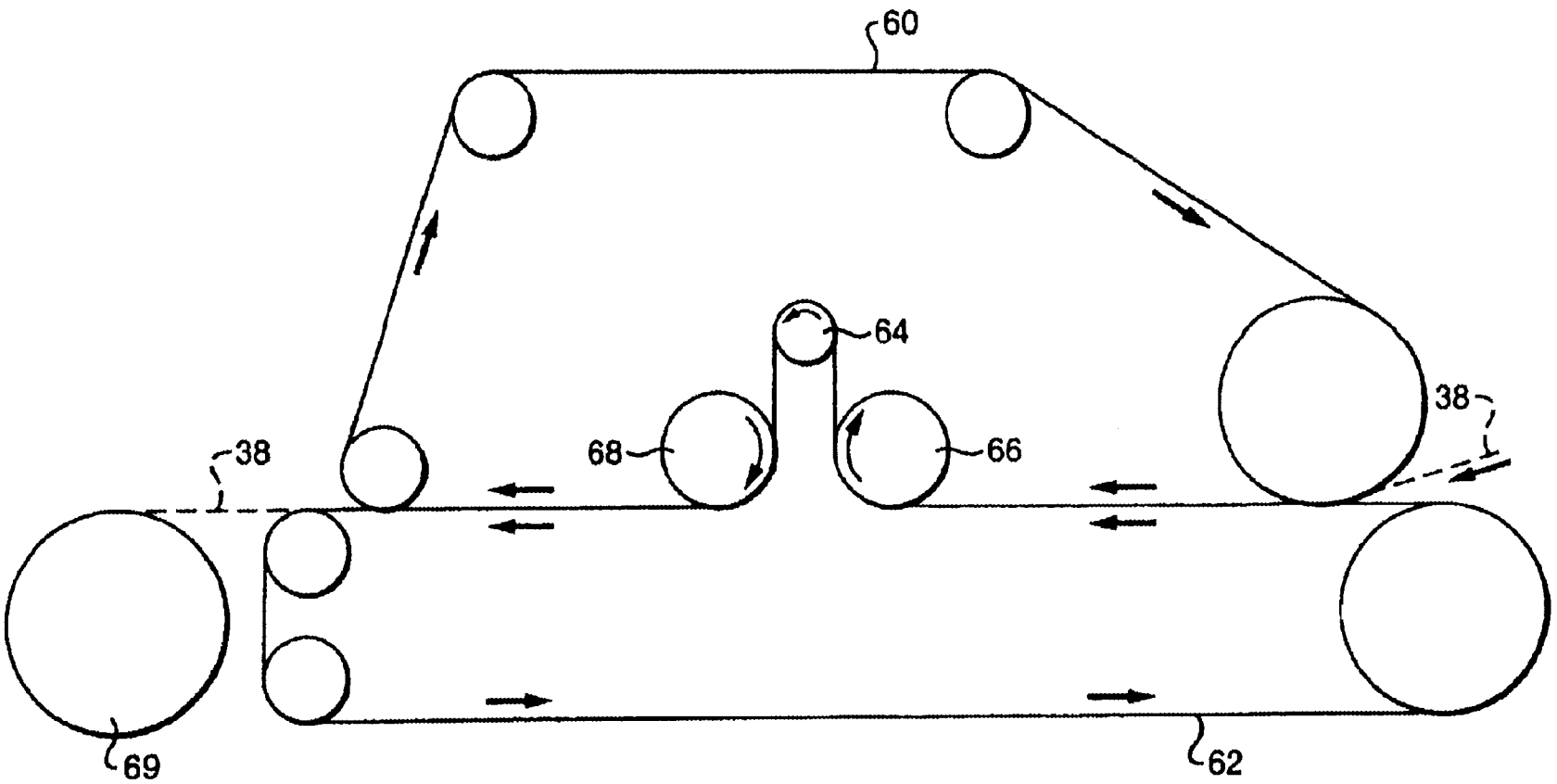
FIG. 4 is a schematic diagram of one embodiment for a process for improving the tactile properties of a formed base web in accordance with the present invention.

After the base web 38 is formed, such as through one of the processes illustrated in FIGS. 2 and 3 or any other suitable process, the web is placed in between a pair of moving conveyors and pressed around a shear inducing roll in accordance with the present invention. For instance, one embodiment of a process for improving the tactile properties of a base web in accordance with the present invention is illustrated in FIG. 4. As shown, the base web 38 is supplied in between a first moving conveyor 60 and a second moving conveyor 62. The speed at which the conveyors 60 and 62 are moving is generally not critical to the present invention. For most commercial applications, the conveyors can be moving at a speed of from about 1,000 feet per minute to about 6,000 feet per minute.

Once positioned in between the first conveyor 60 and the second conveyor 62, the base web and the conveyors are guided around a shear inducing roll 64 by a pair of support rolls 66 and 68. Generally, conveyors 60 and 62 will be traveling at about equal speeds.

In accordance with the present invention, the conveyors 60 and 62 are placed under tension and are wrapped around the shear inducing roll 64 in amounts sufficient to create shear forces that act upon the base web 38. In order to act sufficiently upon the base web between them, conveyors 60 and 62 must be constructed in such a manner so as to impart the necessary shear forces. That is, the conveyors 60 and 62 must have sufficient coefficient of friction so as to act upon the base web surface in contact with either conveyor. Thickness of the conveyors may also play a part in ensuring the ability of the conveyors to impart sufficient shear forces to the web when the conveyors are wrapped around the shear inducing roll with the web between them.

In particular, when the conveyors are passed over the shear inducing roll 64, a surface speed differential is established between the surfaces of the web due to the difference in path length of the two conveyors around the shear inducing roll. This differential in surface speed creates shear forces which act upon the web. The shear force breaks bonds within the web where the web is weakest which subsequently increases the softness and decreases the stiffness of the web. Further, the present inventors have discovered that these improvements are realized without a significant decrease in tensile strength as normally occurs in other processes designed to increase softness.

When fed around the shear inducing roll 64, base web 38 should generally have a low moisture content. For example, the base web 38 should have a moisture content of less than about 10% by weight, particularly less than about 5% by weight, and more particularly less than about 2% by weight.

As shown in FIG. 4, the shear inducing roll 64 can be a rotating roll having a relatively small diameter. In other embodiments, however, the shear inducing roll can be a stationary roll. The effective diameter of the shear inducing roll, for most applications, should be less than about 10 inches, particularly less than about 7 inches and more particularly from about 2 inches to about 6 inches.

The amount that conveyors 60 and 62 are wrapped around the shear inducing roll 64 can vary depending upon the particular application and the amount of shear that is desired to be exerted on the web. For most applications, however, the conveyors should be wrapped around the shear inducing roll in an amount from about 40° to about 270°, particularly from about 80° to about 200°, and more particularly from about 100° to about 180°. In the embodiment illustrated in FIG. 4, the amount of wrap placed around the shear inducing roll can be adjusted by adjusting the position of either the shear inducing roll 64 or the support rolls 66 and 68. For instance, by moving the shear inducing roll 64 down closer to the support rolls 66 and 68, the conveyors will wrap around the shear inducing roll 64 to a lesser extent.

As described above, besides the amount of wrap that is placed around the shear inducing roll, the amount of tension placed upon the conveyors 60 and 62 also has an impact on the amount of shear that is exerted on the base web 38. The amount of tension placed upon the conveyors will depend upon the particular application. For most applications, however, the conveyors 60 and 62 should be placed under tension in an amount from about 5 pounds per linear inch to about 90 pounds per linear inch, particularly from about 10 pounds per linear inch to about 50 pounds per linear inch, and more particularly from about 30 pounds per linear inch to about 40 pounds per linear inch.

As described above, when the conveyors 60 and 62 are wrapped around the shear inducing roll 64 under a sufficient amount of tension, a surface speed differential develops between the two surfaces of the web which creates the shear forces. For most applications, the path length differential between the two conveyors should be from about 0.5% to about 5%, and particularly from about 1% to about 3%.

After the base web 38 has been guided around the shear inducing roll 64, the web can be further processed as desired. In one embodiment, as shown in FIG. 4, the web can be collected onto a reel 69 for later packaging. During this process, the tactile properties of the base web can be greatly enhanced, without seriously affecting the strength of the web.

Figure 5:
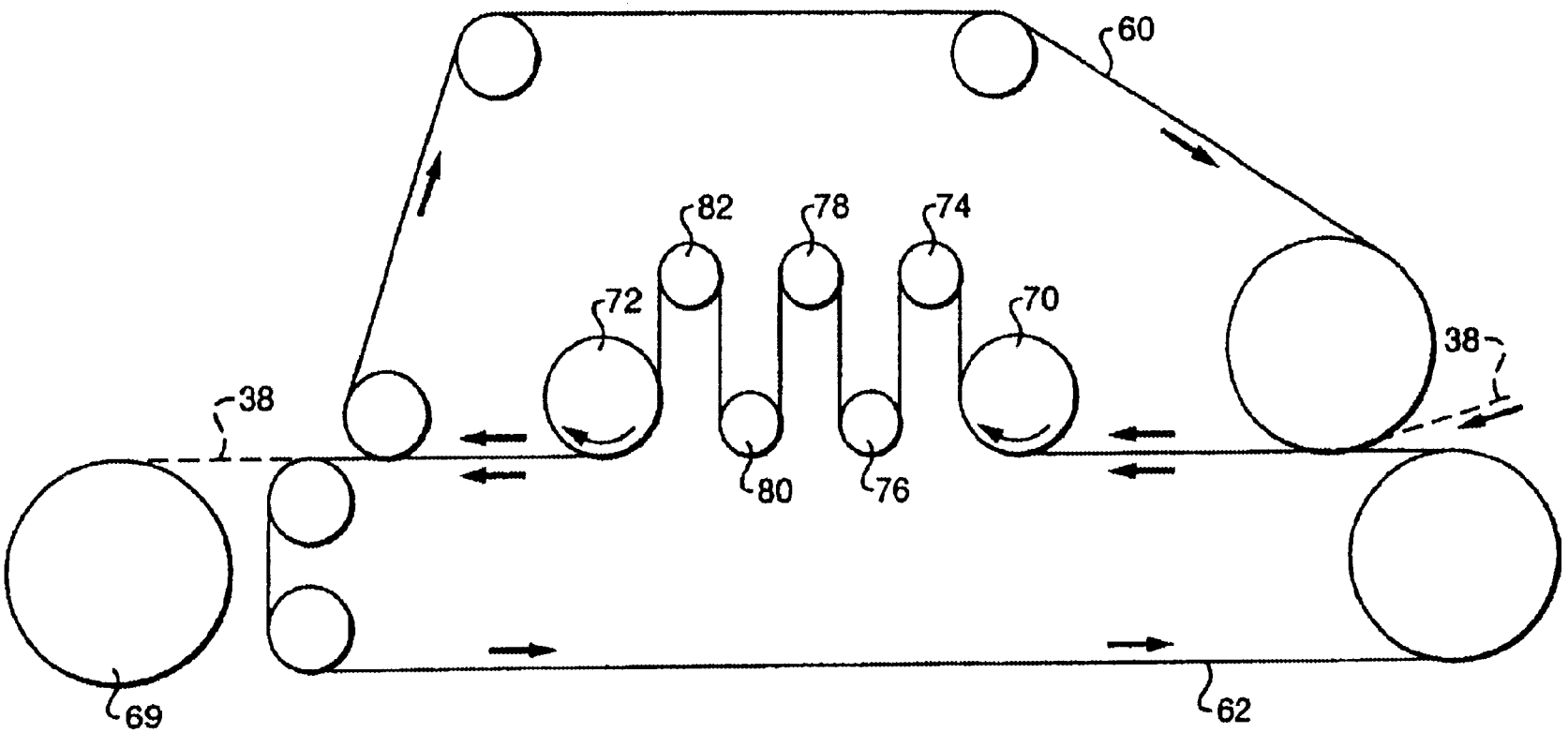
FIG. 5 is a schematic diagram of an alternative embodiment of a process for improving the tactile properties of a formed base web made in accordance with the present invention.

In the embodiment illustrated in FIG. 4, the system includes a single shear inducing roll 64. In other embodiments, however, more shear inducing rolls can be used. For instance, in other embodiments, the conveyors can be wrapped around two shear inducing rolls, three shear inducing rolls, and even up to ten shear inducing rolls. Referring to FIG. 5, an alternative embodiment of the present invention is illustrated that includes five shear inducing rolls.

As shown, the base web 38 is fed between the first conveyor 60 and the second conveyor 62 and is then wrapped around support rolls 70 and 72 and shear inducing rolls 74, 76, 78, 80, and 82. In general, using more shear inducing rolls can create more shear that is exerted on the base web. Although the shear inducing rolls are illustrated in the figures as having equal diameters, alternative embodiments may be desired with shear inducing rolls having diameters which are not equal to each other.

Figure 6:
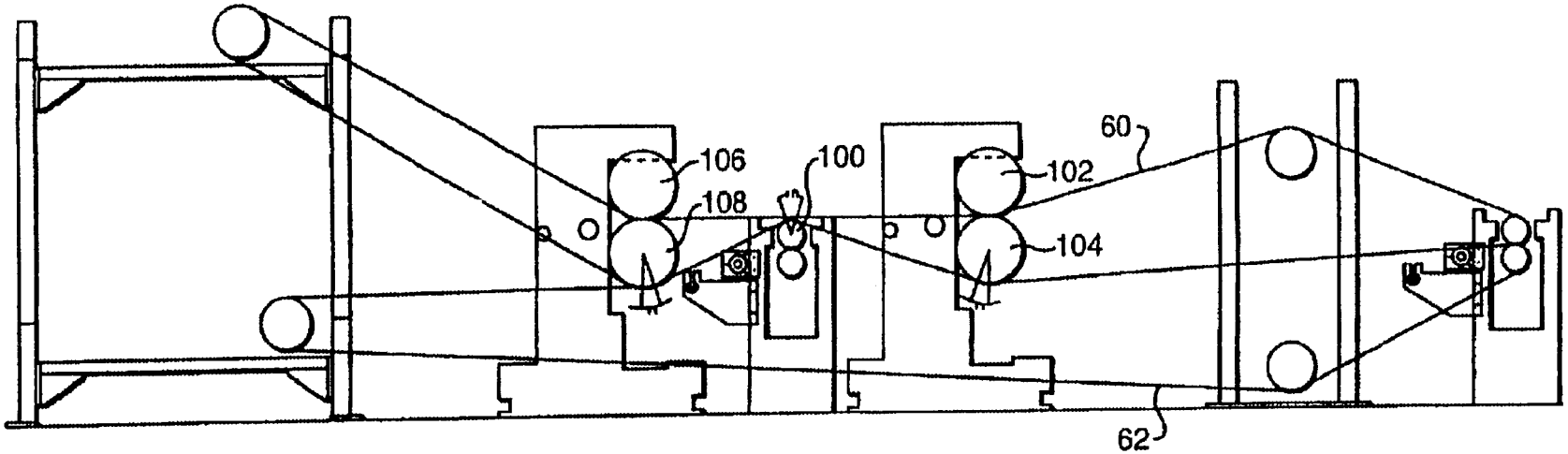
FIG. 6 is a schematic diagram of another alternative embodiment of a process for improving the tactile properties of a formed base web made in accordance with the present invention.
Figure 7:
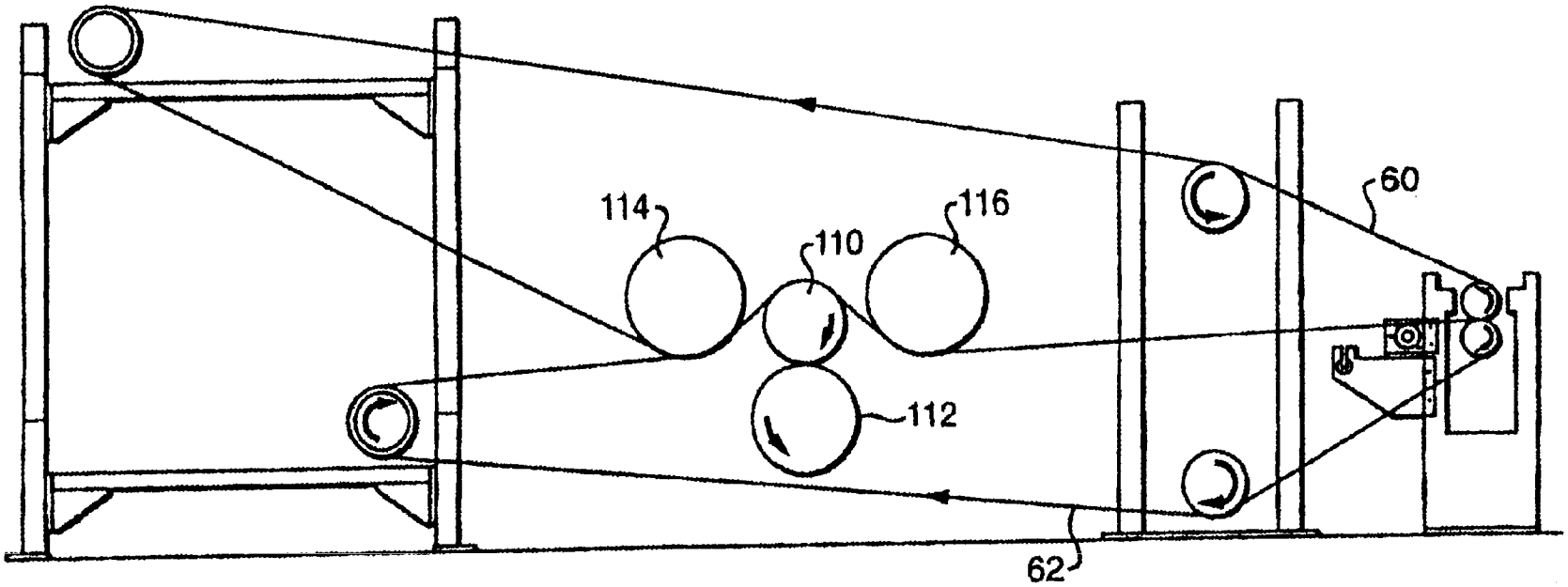
FIG. 7 is a schematic diagram of a further alternative embodiment of a process for improving the tactile properties of a formed base web made in accordance with the present invention.

Further embodiments of systems made in accordance with the present invention are illustrated in FIGS. 6 and 7. The system illustrated in FIG. 6 includes a single shear inducing roll 100. As shown, conveyors 60 and 62 are guided around the shear inducing roll 100 by support rolls 102, 104, 106 and 108.

The system illustrated in FIG. 7 also includes a single shear inducing roll 110. It should be understood, however, that more shear inducing rolls can be included in any of the systems illustrated. As shown in FIG. 7, shear inducing roll 110 is supported by a backing roll 112. In order to facilitate the amount of wrap around shear inducing roll 110, the system further includes support rolls 114 and 116.

In some applications, it has been discovered that the caliper of the web can be dramatically reduced. Caliper reduction without adversely affecting other properties of the web is beneficial in that more material can be placed upon reel 69, which provides various processing benefits. The amount of caliper reduction for a given base web will depend upon the application. In general, the reduction of the caliper of a sheet is governed by the pressure P applied to the sheet by the tension T of the fabrics as the sheet passes around a roll of radius R. This relationship can be described by the equation P=T/R, wherein:

P is pressure in psi,

R is the radius in inches, and

T is the tension in pounds per inch.

Figure 10:
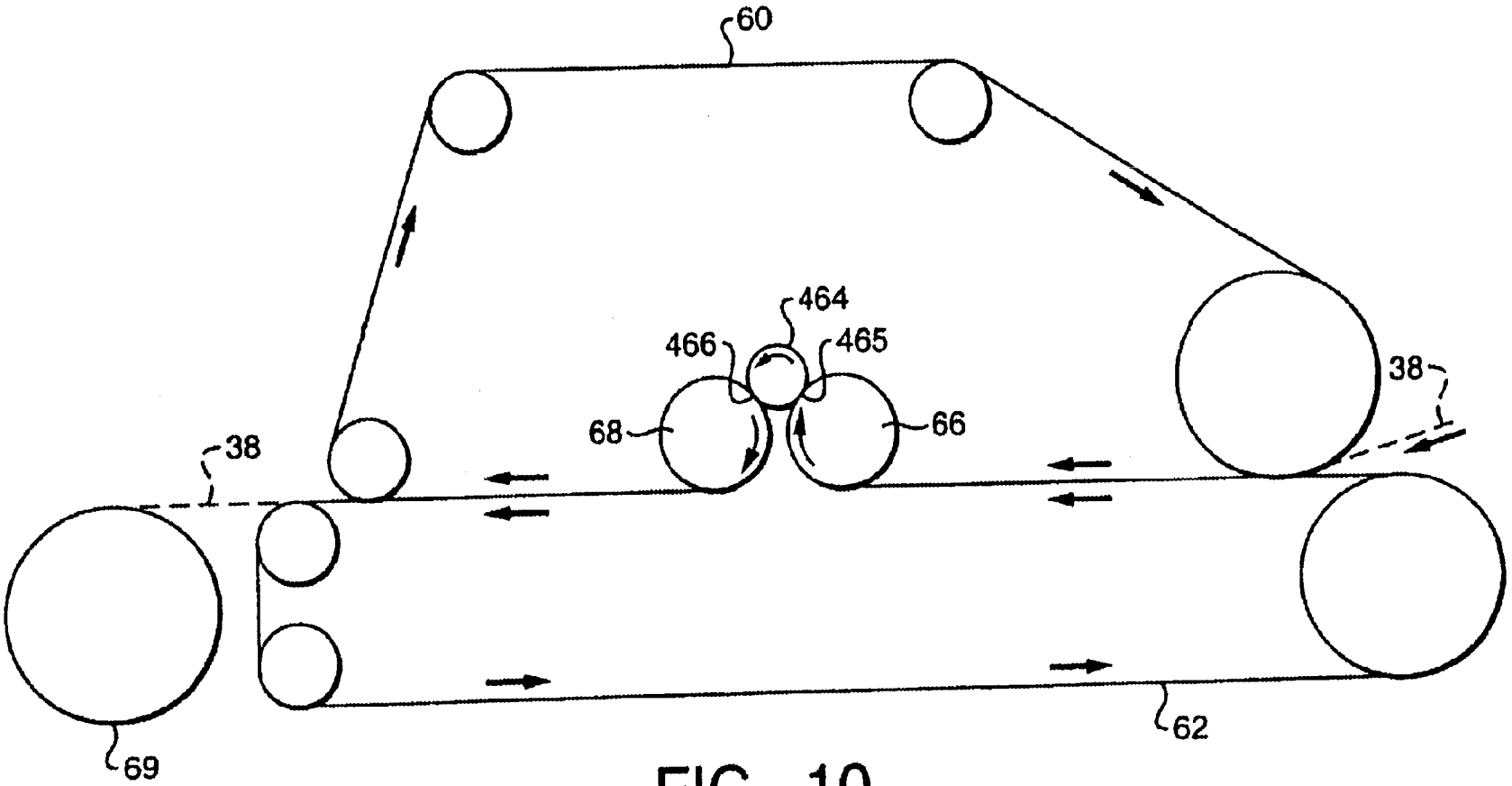
FIG. 10 is a schematic diagram of an embodiment of a process for improving the tactile properties and decreasing the caliper of a formed base web made in accordance with the present invention.
Figure 11:
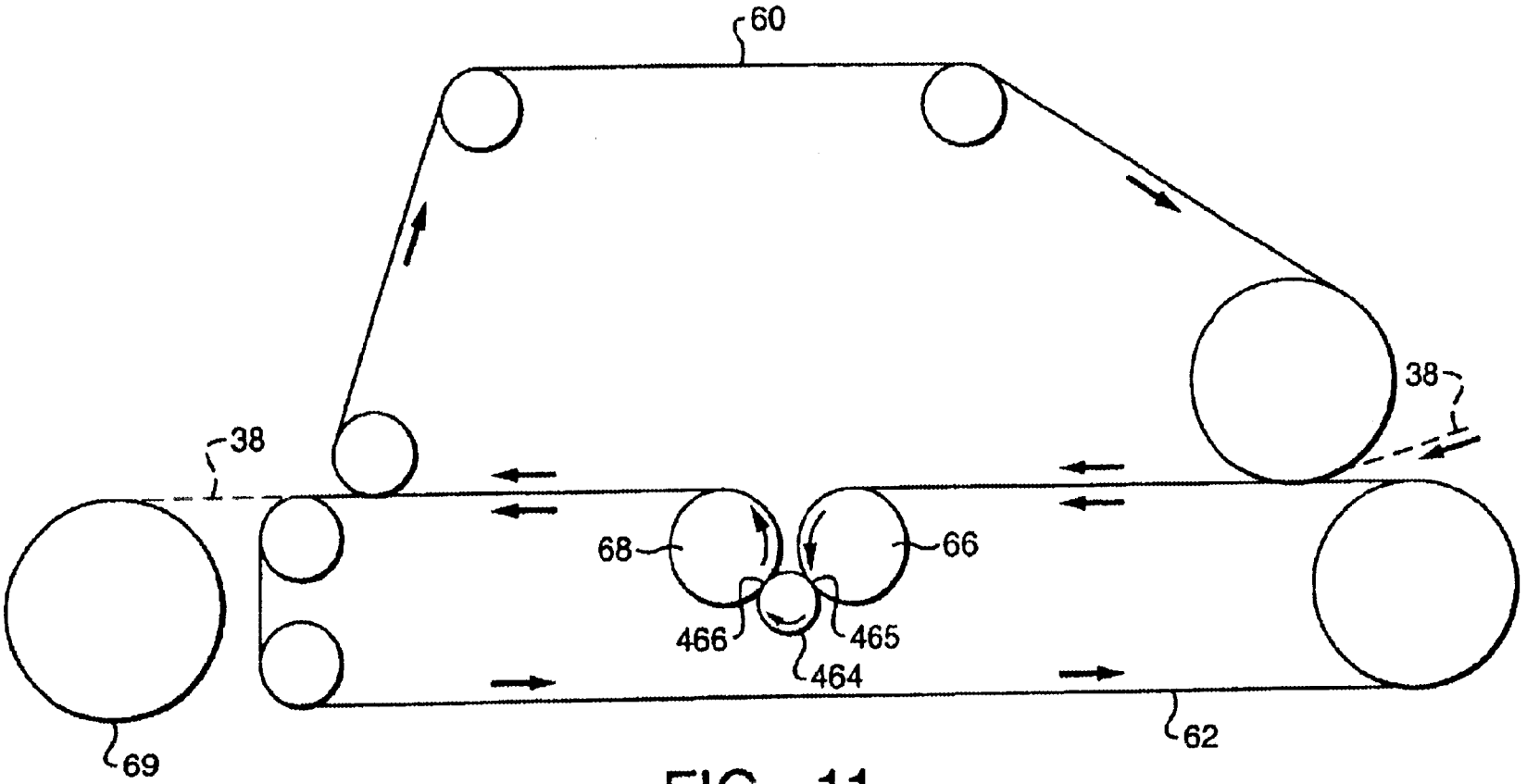
FIG. 11 is a schematic diagram of another embodiment of a process for improving the tactile properties and decreasing the caliper of a formed base web made in accordance with the present invention.
Figure 12:
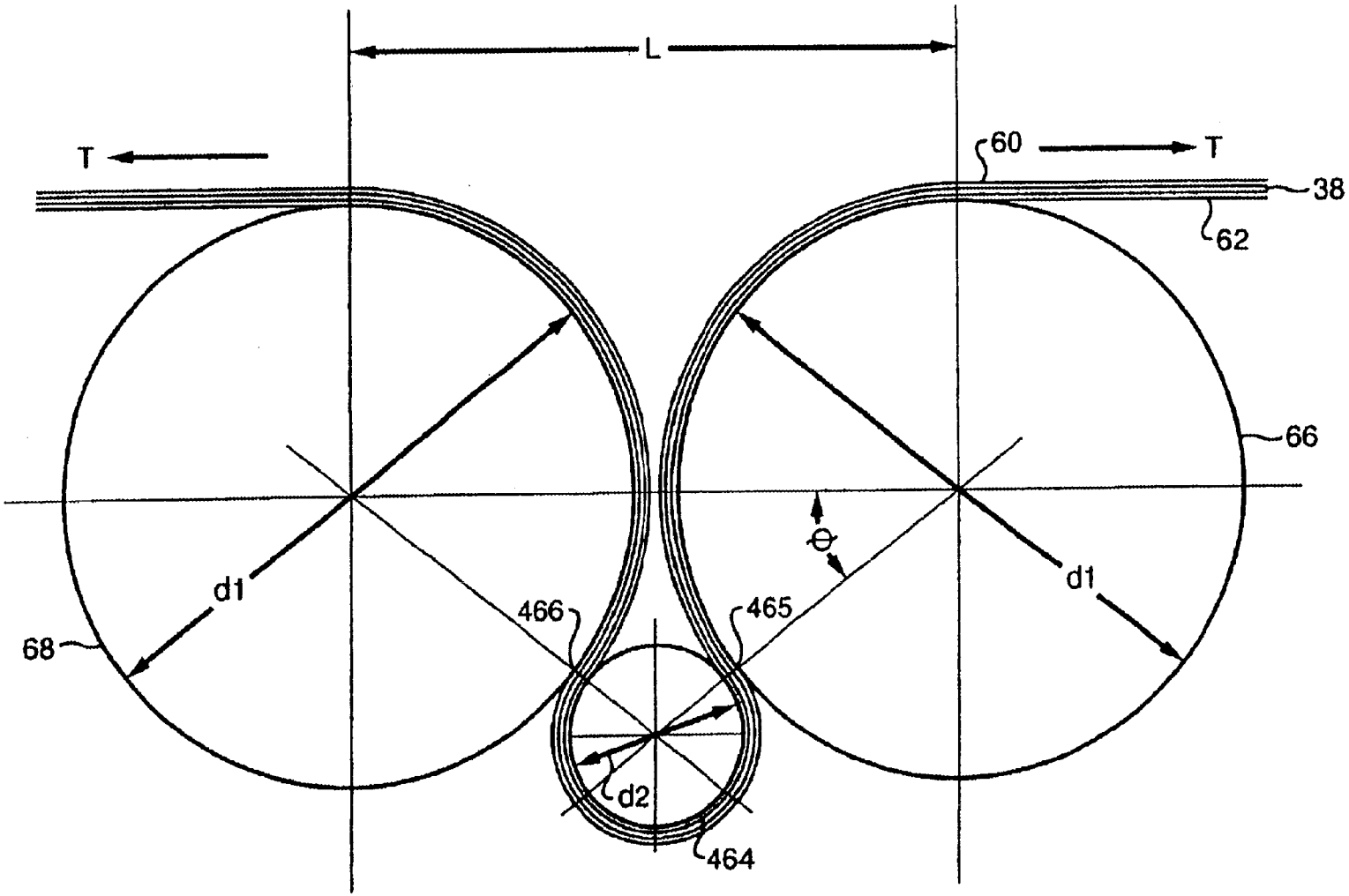
FIG. 12 is a schematic diagram of some of the forces acting on a formed base web when subjected to the process and system illustrated in FIG. 11.

In the embodiments illustrated in FIGS. 10, 11, and 12, the shear inducing process has been combined with a calendering process. The shear inducing roll 464 and the support rolls 66 and 68 are located adjacent to one another in order to create nips between the shear inducing roll and each of the support rolls 66 and 68. The illustrated arrangement can provide for an increase in pressure on the web beyond that provided due to the tension of the conveyors as the web wraps around the shear inducing roll. The added nip pressures can thus further decrease the caliper of the base web.

The amount of caliper reduction achieved can be controlled by adjusting numerous variables. The number of shear inducing rolls, the radius of the rolls, dwell time within the nip(s), nip pressure, conveyor type and base sheet structure all may have an impact on the amount of caliper the process can remove. Percent caliper reduction can increase with an increase in dwell time, number of rolls, nip pressure, and fabric mesh. Dwell time can be affected by the secondary variables of speed and wrap angle. Nip pressure can be varied by the secondary variables of fabric tension and roll diameter. Fabric mesh can be varied by using fabrics of differing knuckle surfaces. Thus far, it has been discovered that the caliper of a base web can be decreased up to as much as 75%, and particularly from about 20% to about 70%.

Referring to FIG. 10, one embodiment of the present invention is shown. A base web 38 is fed in between a first moving conveyor 60 and a second moving conveyor 62. As illustrated, the conveyors are wrapped around a shear inducing roll 464. The conveyors can be guided around the shear inducing roll 464 by a pair of support rolls 66 and 68 which can be positioned on either side of the shear inducing roll. In this embodiment, the shear inducing roll 464 can be placed in contact with the two support/guide rolls 66 and 68 creating two nips 465 and 466. In this manner, the shear inducing roll 464 cannot only serve to subject the base web 38 to shear forces and to compressive forces as described above, but also can serve as a nip roll in a calendering process. In other words, the shear inducing roll additionally is a nip roll.

In one embodiment, the shear inducing roll 464 can be fixed in relationship to support rolls 66 and 68. Alternatively, the shear inducing roll 464 can be fixed in only the axial direction of the roll. The axial direction is defined as the cross machine direction. At the same time, the shear inducing roll 464 can be free to move in other directions, such as the machine direction as well as vertically. In this particular embodiment, the fixing of shear inducing roll 464 in only the axial direction of the shear inducing roll can keep fabric guidance steady, yet allow shear inducing roll 464 to be pulled and held against support rolls 66 and 68 by the tension of conveyors 60 and 62 and the weight of shear inducing roll 464. In this manner, the tension of the conveyors can control not only the amount of caliper reducing pressure on the base web as it wraps around the shear inducing roll, but also can control the nip pressures.

In accordance with the present invention, the two nips, 465 and 466, between the shear inducing roll and the support rolls can serve to reduce the caliper of the base web beyond the caliper reduction gained when the fabric is merely guided around the shear inducing rolls with no additional nip pressure. Further, the double nip that is formed can allow lower nip loads in each nip when compared to a system that contains a single nip.

Referring to FIG. 11, an embodiment similar to the system illustrated in FIG. 10 is shown. As shown, the shear inducing roll 464 can be placed below the support rolls 66 and 68. Consequently, the pressure that is generated at nips 465 and 466 is not increased due to the weight of the shear inducing roll. Instead, the pressure applied at nips 465 and 466 can be more dependent upon the tension of the first and second conveyors 60 and 62.

Some of the relationships of the embodiment shown in FIG. 11, when shear inducing roll 464 is fixed only in the cross machine direction, are further illustrated in FIG. 12. The nip pressure on the fabric at the nip 465 may be represented as:

$$N=2T\cos\theta-W/2\sin\theta$$

where:

T is the tension of conveyors 60 and 62 where not in contact with shear inducing roll 464, θ is the angle between the line connecting the centers of support rolls 66 and 68 and the line connecting the center of support roll 66 with the center of shear inducing roll 464, and W is the weight of shear inducing roll 464.

Thus, the nip pressure will increase as the angle θ decreases.

The nip pressure at nip 466 is similar, with the exception that in this case θ is the angle between the line connecting the centers of support rolls 66 and 68 and the line connecting the center of support roll 68 with the center of shear inducing roll 464.

The length L between the centers of support rolls 66 and 68 must be such as to prevent shear inducing roll 464 from actually passing between support rolls 66 and 68. Thus the angle θ will always be greater than 0°. Shear inducing roll 464 may be placed above or below support rolls 66 and 68, as long as the weight, W, of shear inducing roll 464 is properly taken into account when figuring the nip pressure (i.e. it will be added rather than subtracted in the formula if shear inducing roll 464 is above the support rolls).

The embodiments shown in FIGS. 10 and 11 offer benefits in addition to increased caliper reduction. For example, in the embodiment illustrated in FIG. 4, as the diameter of shear inducing roll 64 becomes very small, deflection in the shear inducing roll 64 may be induced in the cross machine direction by the tension of the fabric passing over the roll. Deflection can lead to machine vibration, problems with fabric guiding and lack of product uniformity. In contrast, in the embodiments illustrated in FIGS. 10 and 11, support rolls 66 and 68 support and guide the fabric and also support shear inducing roll 464. This support can prevent deflection across shear inducing roll 464 during operations. This feature can be especially beneficial when shear inducing roll 464 has a small diameter of less than about 20 inches.

For most applications, support rolls 66 and 68 can have a diameter (shown as d1 in FIG. 12) greater than the diameter of shear inducing roll 464 (shown as d2 in FIG. 12). For example, in one embodiment, support rolls 66 and 68 can have a diameter d1 of from about 20 inches to about 50 inches. Although support rolls 66 and 68 are illustrated in the figures as having equal diameters, alternative embodiments may be desired with support rolls 66 and 68 having diameters which are not equal to each other. This may be desired, for example, if different nip pressures are desired at the nips 465 and 466.

Support rolls 66 and 68 can be made from any suitable material that can provide support and prevent deflection. For example, support rolls 66 and 68 can be made from a metal such as steel, known as an anvil roll. Alternatively, support rolls 66 and 68 can have a steel core construction with an outer surface made from an elastomeric material, such as rubber.

Similar to the other embodiments described above, in the embodiments shown in FIGS. 11 and 12, shear inducing roll 464 can have a diameter of less than about 20 inches, particularly less than about 10 inches, and more particularly from about 2 inches to about 6 inches. Use of a small diameter roll can increase shear forces to be exerted on base web 38 and can also provide sufficient pressure for reducing the caliper of the web.

Figure 13:
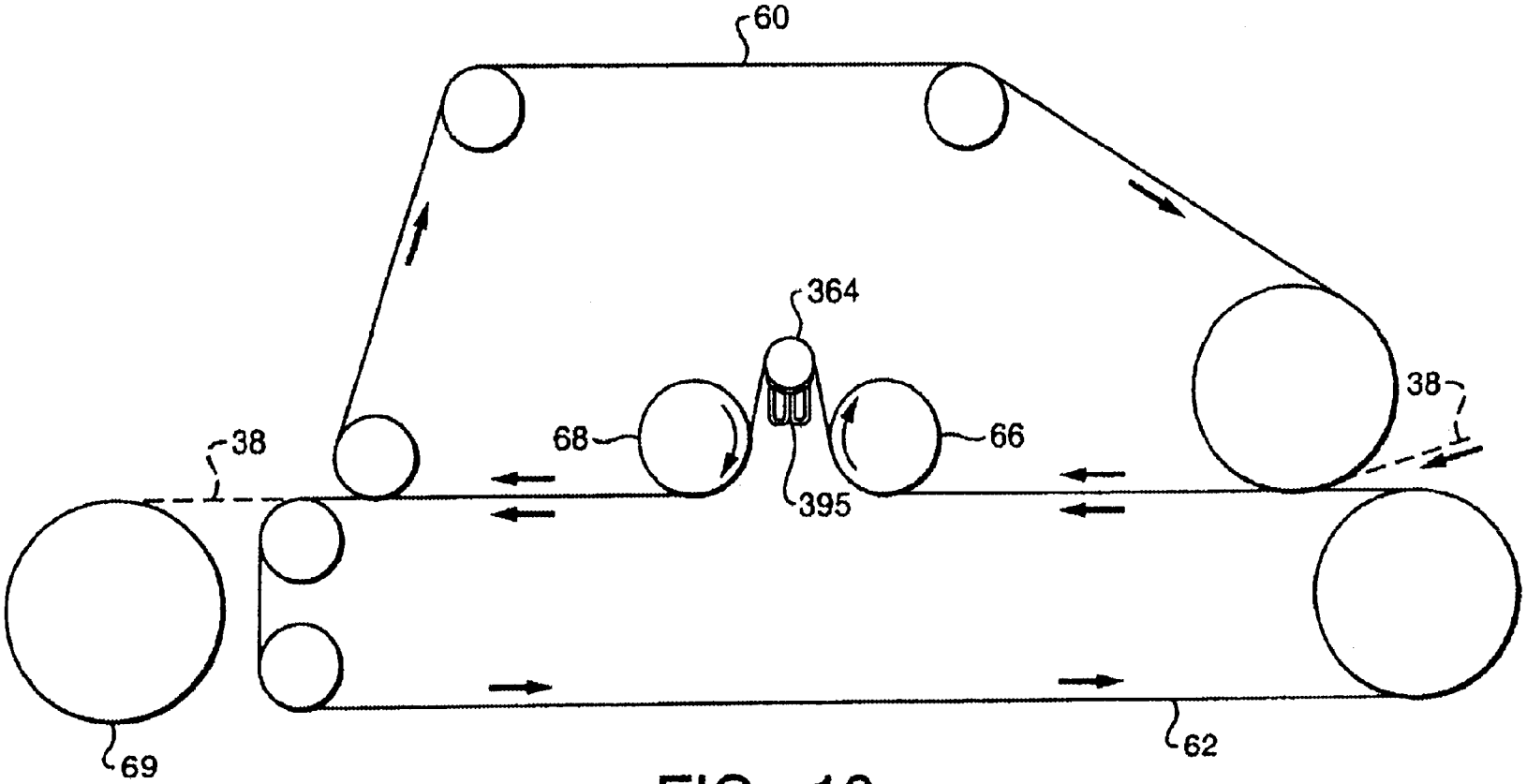
FIG. 13 is a schematic diagram of another embodiment of the present invention including an air bearing.
Figure 14:
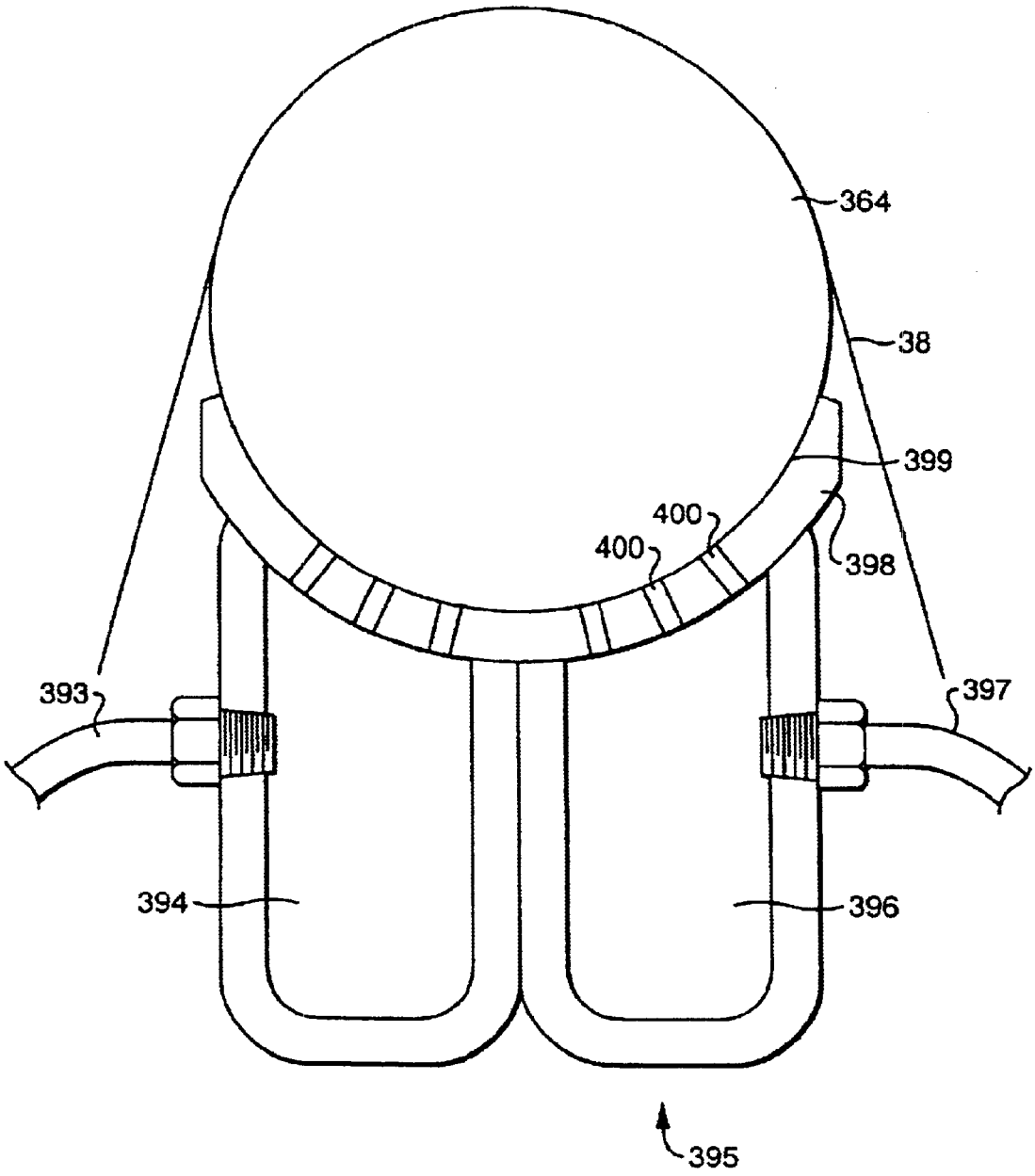
FIG. 14 is another diagram of the air bearing of FIG. 13.

Another alternative embodiment of the present invention is shown in FIGS. 13 and 14. As previously discussed, shear inducing rolls of a very small diameter may have an induced deflection caused by the tension of the conveyors as they pass over the roll. Such deflection may cause uneven pressure across the fabric which in turn could effect machine vibration, fabric guiding, and product uniformity. The embodiment shown in FIGS. 13 and 14 can minimize this deflection through the use of a shear inducing roll positioned upon a bearing which supports the roll using a film of air.

For example, one embodiment of a system incorporating a fluid bearing is illustrated in FIG. 13. As shown, a base web 38 is fed in between a first conveyor 60 and a second conveyor 62. The conveyors 60 and 62 are then guided over a shear inducing roll 364 by guide/support rolls 66 and 68. In this embodiment, shear inducing roll 364 is supported by a stationary beam 395. The stationary beam 395 includes an air bearing for supporting the shear inducing roll 364. It is believed that the air bearing will serve to reduce the possibility of deflection across shear inducing roll 364, even when the diameter of the shear inducing roll is relatively small, such as less than about 10 inches, particularly less than about 6 inches, and more particularly less than about 4 inches.

Referring to FIG. 14, shear inducing roll 364 and stationary beam 395 are shown in more detail. As illustrated, shear inducing roll 364 can be supported on a fluid film 399 over a bearing 398. Usually, the fluid chosen will simply be air, although other fluids could alternatively be employed. The bearing surface can be curved to closely match the curvature of the shear inducing roll 364.

The material of the bearing surface may be a babbitt material or some other plain bearing material molded on and bonded to a suitable support material.

The bearing 398 may be comprised of one or more elements in the cross machine direction, arranged either as a continuous surface, or intermittently across supporting stationary beam 395, as long as support of the shear inducing roll is adequate across the entire roll.

In order to create fluid film 399 upon which shear inducing roll 364 rests, stationary beam 395 includes at least one air chamber 396 in communication with a plurality of air passages 400. In the embodiment illustrated in FIG. 11, stationary beam 395 contains two separate air chambers 396 and 394. A gas, such as air, is supplied to chambers 394 and 396 via air inlets 393 and 397. In one embodiment, the gas pressure within chambers 394 and 396 are independently controlled using separate pressure regulators which are placed in communication with inlets 393 and 397. Separate pressure regulation of the chambers will enable effective control of the gas flow such that shear inducing roll 364 will be held approximately centered over the bearing 398.

The stationary beam 395 carrying the air bearing 398 may support the entire roll face, or it may include the use of additional bearings at the ends of the roll to support the roll and journals and to prevent the roll from moving in the axial, cross machine direction. As used herein, the axial direction of the roll is across the beam in the cross direction of the fabric. These additional bearings may be ceramic or some other suitable material which will allow acceptable bearing life for the high rpm and load involved.

The system may additionally provide for a method to prevent contaminants from entering the air bearing area. For instance, a creping blade can be used to scrape the roll as it rotates into the bearing area.

Figure 15:
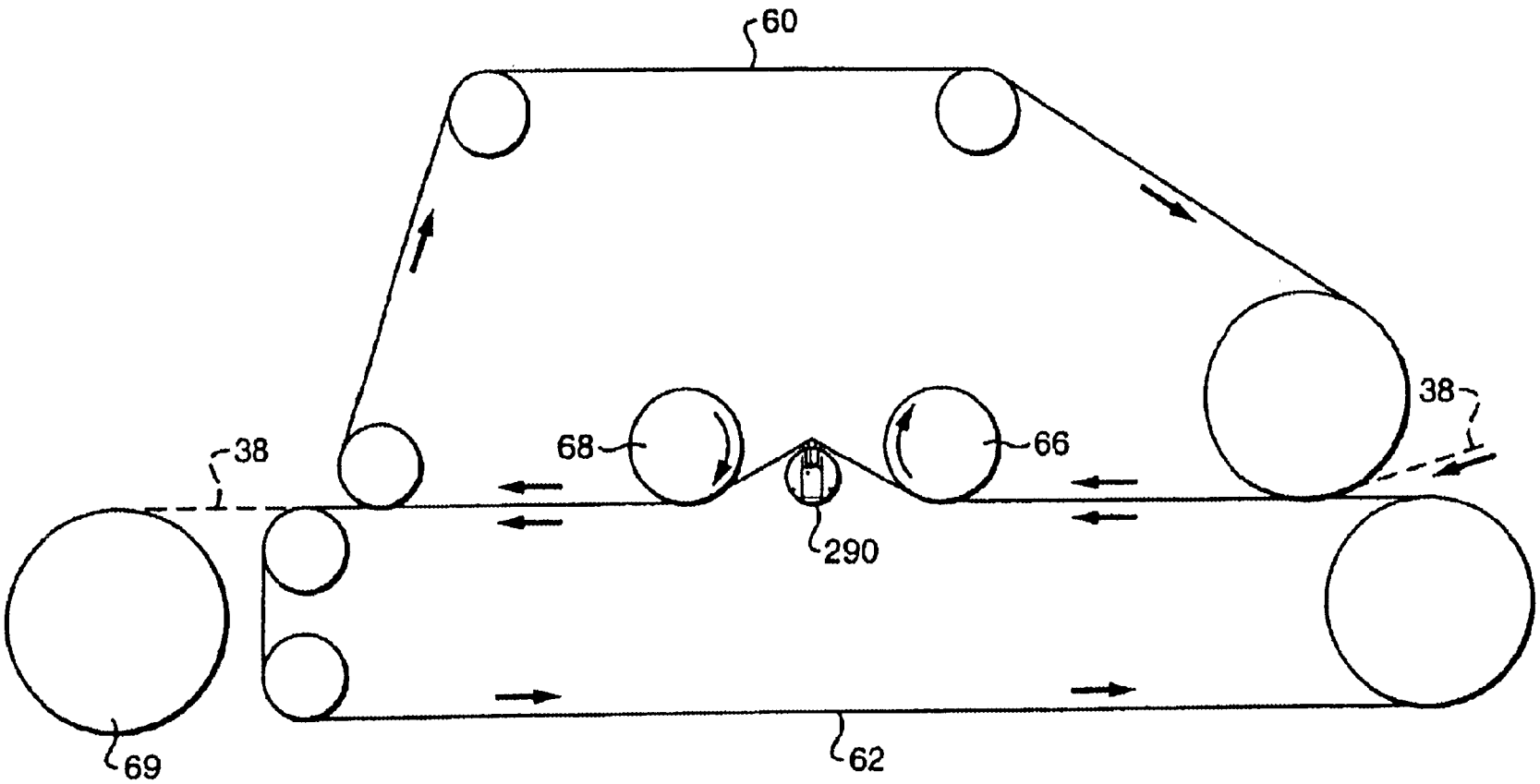
FIG. 15 is a schematic diagram of another embodiment of the present invention including a stationary shoe.
Figure 16:
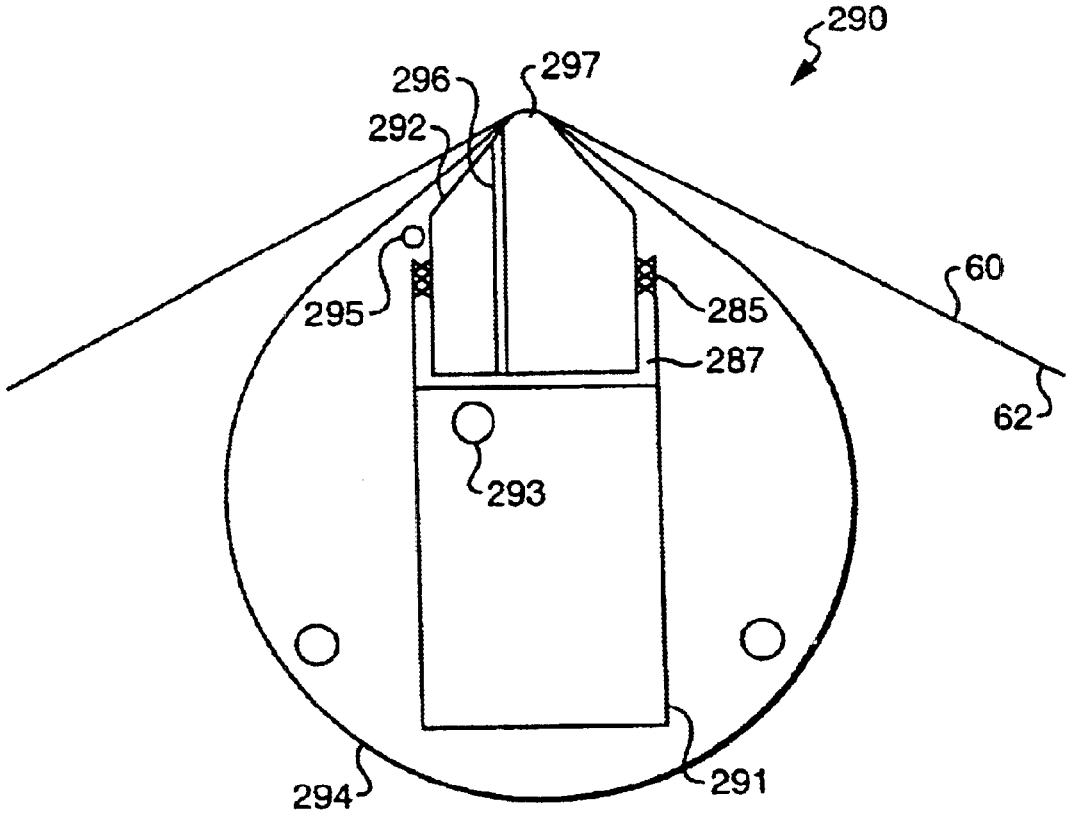
FIG. 16 is another diagram of the stationary shoe of FIG. 15.

Yet another alternative embodiment of the present invention is illustrated in FIGS. 15 and 16. In this particular embodiment, a stationary shoe 290 acts as the shear inducing roll, rather than a conventional roller. This particular embodiment may provide certain advantages such as, for example, deflection prevention across the shoe.

Referring to FIG. 15, one embodiment of a system including stationary shear inducing shoe 290 having a small effective diameter is shown. The stationary shoe 290 can have an effective diameter for instance, of less than about ten inches, particularly less than about six inches, and more particularly less than about four inches.

FIG. 16 illustrates the stationary shear inducing shoe 290 in more detail. As shown, shoe 290 is comprised of a stiff, stationary support beam 291 which can be wrapped by a flexible polymer belt 294. Generally, polymer belt 294 is free to rotate about shoe 290. The flexible polymer belt 294 may be made from a solid sheet of material which is impervious to oil. For example, belt 294 can be made from a fiber reinforced polymer such as a polyurethane.

Shoe 291 has a convex outer edge 297 which serves as a small diameter shear inducing roll. The convex outer edge 297 is defined by a shoe element 292. Shoe element 292 may be moved toward and away from polymer belt 294 as it passes over outer edge 297. This movement can increase or decrease tension of conveyors 60 and 62 which in turn varies the pressure on the nonwoven web 38.

Pressure on web 38 is governed by the equation $P=T/R$ where

T is the tension of the conveyors and

R is the effective radius of the shoe.

The pressure exerted on the web 38 is limited by product specifications, including product type and caliper reduction sought.

Shoe element 292 may be either hydraulically or pneumatically controlled. If hydraulically controlled, as in FIG. 16, any suitable fluid, such as, for example, oil, can be supplied via fluid supply 293. Fluid supply 293 can provide fluid for hydraulic control of shoe element movement as well as providing fluid through port 296 to misting shower 295 for lubricating the polymer belt 294 as it rotates around the shoe. Misting shower 295 may alternatively be any means for reducing friction between shoe element 292 and polymer belt 294.

The embodiment illustrated in FIG. 15 may be further configured to allow for additional control of pressure against the web 38 and tension of the conveyors 60 and 62. Such a configuration may include, for example, more than one shoe element along the axial direction of the shoe, the shoe elements being adjacent to each other across the entire shoe. The shoe's axial direction is defined as the cross direction of the fabric. Movement of each separate shoe element could then be independently controlled through, for example, a feedback control loop to ensure less variation in conveyor tension and web pressure across the machine.

Alternatively, individual shoe elements could be configured with separate control zones in the axial direction. Again, such a configuration would allow for independent control of pressure and tension acting on the web in the cross direction and decrease the possibility of variation in product properties.

As stated above, base webs processed according to the present invention can be made from various materials and fibers. For instance, base web 38 can be made from pulp fibers, other natural fibers, synthetic fibers, and the like.

For instance, in one embodiment of the present invention, base web 38 contains pulp fibers either alone or in combination with other types of fibers. The pulp fibers used in forming the web can be, for instance, softwood fibers having an average fiber length of greater than 1 mm and particularly from about 2 to 5 mm based on a length weighted average. Such fibers can include Northern softwood kraft fibers. Secondary fibers obtained from recycled materials may also be used.

In one embodiment, staple fibers (and filaments) can be added to web 38 to increase the strength, bulk, softness and smoothness of web 38. Staple fibers can include, for instance, polyolefin fibers, polyester fibers, nylon fibers, polyvinyl acetate fibers, cotton fibers, rayon fibers, nonwoody plant fibers, and mixtures thereof. In general, staple fibers are typically longer than pulp fibers. For instance, staple fibers typically have fiber lengths of 5 mm and greater.

The staple fibers added to base web 38 can also include bicomponent fibers. Bicomponent fibers are fibers that can contain two materials such as but not limited to in a side by side arrangement or in a core and sheath arrangement. In a core and sheath fiber, generally the sheath polymer has a lower melting temperature than the core polymer. For instance, the core polymer, in one embodiment, can be nylon or a polyester, while the sheath polymer can be a polyolefin such as polyethylene or polypropylene. Such commercially available bicomponent fibers include CELBOND fibers marketed by the Hoechst Celanese Company.

The staple fibers used in base web 38 of the present invention can also be curled or crimped. The fibers can be curled or crimped, for instance, by adding a chemical agent to the fibers or subjecting the fibers to a mechanical process. Curled or crimped fibers may create more entanglement and void volume within the web and further increase the amount of fibers oriented in the Z direction as well as increase web strength properties.

In one embodiment, when forming paper products containing pulp fibers, the staple fibers can be added to the web in an amount from about 5% to about 30% by weight and particularly from about 5% to about 20% by weight.

When base web 38 of the present invention is not used to make paper products, but instead is incorporated into other products such as diapers, feminine hygiene products, garments, personal care products, and various other products, base web 38 can be made from greater amounts of staple fibers.

Besides pulp fibers and staple fibers, thermomechanical pulp can also be added to base web 38. Thermomechanical pulp, as is known to one skilled in the art, refers to pulp that is not cooked during the pulping process to the same extent as conventional pulps. Thermomechanical pulp tends to contain stiff fibers and has higher levels of lignin. Thermomechanical pulp can be added to the base web of the present invention in order to create an open pore structure, thus increasing bulk and absorbency and improving resistance to wet collapse.

When present, the thermomechanical pulp can be added to the base web in an amount from about 10% to about 30% by weight. When using thermomechanical pulp, a wetting agent is also preferably added during formation of web 38. The wetting agent can be added in an amount less than about 1% and, in one embodiment, can be a sulphonated glycol.

In some embodiments, it is desirable to limit the amount of inner fiber-to-fiber bond strength. In this regard, the fiber furnish used to form base web 38 can be treated with a chemical debonding agent. The debonding agent can be added to the fiber slurry during the pulping process or can be added directly into the headbox. Suitable debonding agents that may be used in the present invention include cationic debonding agents such as fatty dialkyl quaternary amine salts, mono fatty alkyl tertiary amine salts, primary amine salts, imidazoline quaternary salts, and unsaturated fatty alkyl amine salts. Other suitable debonding agents are disclosed in U.S. Pat. No. 5,529,665 to Kaun which is incorporated herein by reference.

In one embodiment, the debonding agent used in the process of the present invention can be an organic quaternary ammonium chloride. In this embodiment, the debonding agent can be added to the fiber slurry in an amount from about 0.1% to about 1% by weight, based on the total weight of fibers present within the slurry.

Base web 38 of the present invention may also have a multi-layer construction. For instance, web 38 can be made from a stratified fiber furnish having at least three principal layers.

It has been discovered by the present inventors that various unique products can be formed when processing a stratified base web 38 according to the present invention. For example, as described above, the process of the present invention causes web disruption in the area of the web that is weakest. Consequently, one particular embodiment of the present invention is directed to using a stratified base web 38 that contains weak outer layers and a strong center layer. Upon exposure to the shear forces created through the process of the present invention, bonds are broken on the outer surface of the sheet, while the strength of the center layer is maintained. The net effect is a base web 38 having improved softness and stiffness with minimal strength loss.

In an alternative embodiment, a stratified base web 38 can be used that has outer layers having a greater tensile strength and/or shear strength than a middle layer. In this embodiment, upon exposure to the shear forces created by the process of the present invention, bonds in the middle layer fail but the integrity of the outer layers is maintained. The resulting sheet simulates, in some respects, the properties of a two-ply sheet.

Alternatively, in other embodiments, the layers of the stratified base web need not necessarily be of equal construction to each other. It may be desirable to have all layers of different construction and/or tensile strengths.

There are various methods available for creating stratified base webs 38. For instance, referring to FIG. 1, one embodiment of a device for forming a multi-layered stratified fiber furnish is illustrated. As shown, a three-layered headbox generally 10 may include an upper headbox wall 12 and a lower headbox wall 14. Headbox 10 may further include a first divider 16 and a second divider 18, which separate three fiber stock layers. Each of the fiber layers 24, 20, and 22 comprise a dilute aqueous suspension of fibers.

An endless traveling forming fabric 26, suitably supported and driven by rolls 28 and 30, receives the layered stock issuing from headbox 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered webs is also described and disclosed in U.S. Pat. No. 5,129,988 to Farrington, Jr. and in U.S. Pat. No. 5,494,554 to Edwards, et al., which are both incorporated herein by reference.

In forming stratified base webs 38, various methods and techniques are available for creating layers that have different shear strengths and/or tensile strengths. For example, debonding agents can be used as described above in order to alter the strength of a particular layer.

Alternatively, different fiber furnishes can be used for each layer in order to create a layer with desired characteristics. For example, in one embodiment, softwood fibers can be incorporated into a layer for providing strength, while hardwood fibers can be incorporated into an adjacent layer for creating a weaker layer.

More particularly, it is known that layers containing hardwood fibers typically have a lower tensile and shear strength than layers containing softwood fibers. Hardwood fibers have a relatively short fiber length. For instance, hardwood fibers can have a length of less than about 2 millimeters and particularly less than about 1.5 millimeters.

In one embodiment, the hardwood fibers incorporated into a layer of the base web include eucalyptus fibers. Eucalyptus fibers typically have a length of from about 0.8 millimeters to about 1.2 millimeters. When added to web 38, eucalyptus fibers increase the softness, enhance the brightness, increase the opacity, and increase the wicking ability of the web.

Besides eucalyptus fibers, other hardwood fibers may also be incorporated into base web 38 of the present invention. Such fibers include, for instance, birch fibers, maple fibers, and possibly recycled hardwood fibers.

In general, the above-described hardwood fibers can be present in base web 38 in any suitable amount. For example, the fibers can comprise from about 5% to about 100% by weight of one layer of the web.

The hardwood fibers can be present within the lower strength layer of web 38 either alone or in combination with other fibers, such as other cellulosic fibers. For instance, the hardwood fibers can be combined with softwood fibers, with superabsorbent materials, and with thermomechanical pulp.

As described above, stronger tensile strength layers can be formed using softwood fibers, especially when adjacent weaker tensile strength layers are made from hardwood fibers. The softwood fibers can be present alone or in combination with other fibers. For instance, in some embodiments, staple fibers, such as synthetic fibers, can be combined with the softwood fibers.

The weight of each layer of stratified base web 38 in relation to the total weight of the web is generally not critical. In most embodiments, however, the weight of each outer layer will be from about 15% to about 40% of the total weight of web 38, and particularly from about 25% to about 35% of the weight of web 38.

The basis weight of base webs 38 made according to the present invention can vary depending upon the particular application. In general, for most applications, the basis weight can be from about 5 pounds per 2,880 square feet (ream) to about 80 pounds per ream, and particularly from about 6 pounds per ream to about 30 pounds per ream. Some of the uses of base webs 38 include use as a wiping product, as a napkin, as a medical pad, as an absorbent layer in a laminate product, as a placemat, as a drop cloth, as a cover material, as a facial tissue, as a bath tissue, or for any product that requires liquid absorbency.

The present invention may be better understood with reference to the following example.

EXAMPLE

The following example was conducted in order to illustrate the advantages and benefits of the present invention.

In this experiment, paper webs were produced, placed between two fabrics, and then guided around at least one shear inducing roll. More particularly, stratified webs were tested which included three layers. The two outer layers of the web were made from eucalyptus fibers. The middle layer, however, contained softwood fibers. The webs were produced using a through air dryer similar to the system illustrated in FIG. 3. The base webs had an average basis weight of about 18.9 lbs/ream.

Once formed, the webs were then placed in between a pair of fabrics and guided around at least one shear inducing roll, similar to the configuration illustrated in FIG. 4.

In the first set of experiments, the base web and fabric sandwich was wrapped around 3 shear inducing rolls at a pressure of 25 pounds per linear inch. The fabrics were wrapped around the shear inducing rolls in an amount of about 45°.

During the first set of tests, the diameter of the shear inducing rolls was varied between 2 inches, 4.5 inches and 10.5 inches. Further, the amount of softwood fibers contained in the web was also varied (middle layer of the web) from 28% by weight to 31% by weight.

Figure 8:
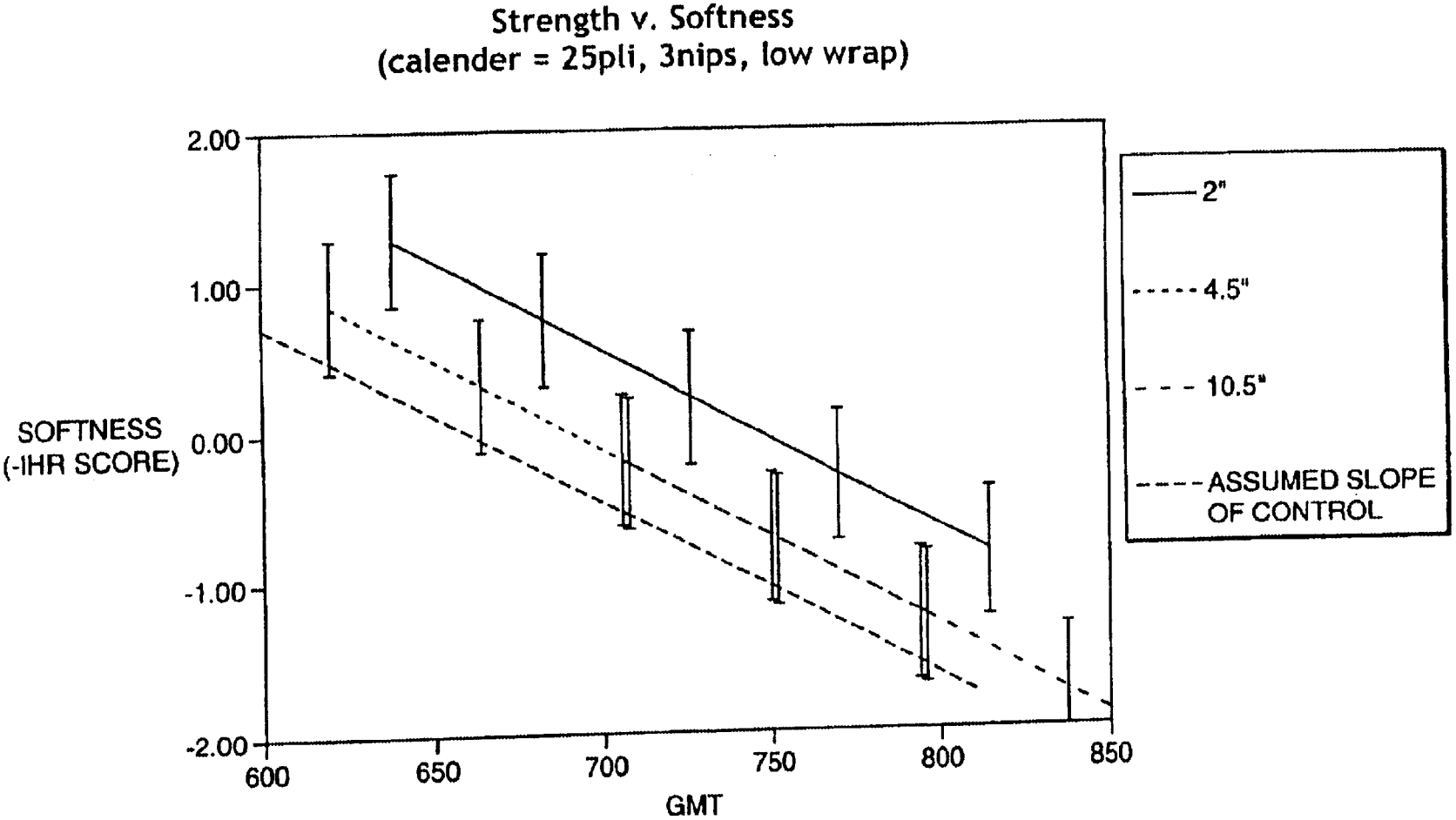
FIGS. 8 and 9 are the results obtained in the example described below.

Linear regression mathematical models were developed for strength and softness in order to create strength and softness curves. The results of the first set of experiments is illustrated in FIG. 8. For purposes of comparison, a control curve was also created. The control curve was produced by calendering the base web at a pressure of 150 pounds per linear inch, instead of subjecting the web to the shear inducing rolls and then estimating a curve.

During these tests, softness was determined using an in hand ranking test (IHR). Panelists received 6 samples and were asked to rank them for softness based upon subjective criteria. Specifically, the panelists received different sets of samples several times. Each sample was coded. Replicates were compared in order to estimate error. The panelists' response data was modeled with Logistic Regression to determine paired scores and log odds.

Strength was determined using a geometric mean tensile strength test (GMT). In particular, the tensile strength of samples was determined in the machine direction and in the cross machine direction. During the test, each end of a sample was placed in an opposing clamp. The clamps held the material in the same plane and moved apart at a ten inch per minute rate of extension. The clamps moved apart until breakage occurred in order to measure the breaking strength of the sample. The geometric mean tensile strength is then calculated by taking the square root of the machine direction tensile strength of the sample multiplied by the cross direction tensile strength of the sample.

In order to construct the graph illustrated in FIG. 8, linear regression models were calculated for strength and softness. Specifically, a Y=f (x) model for strength and softness was created. A spreadsheet was created listing softness and strength values as the percent of softwood in the web varied for each of the three roll diameters of interest (2 inches, 4.5 inches, and 10.5 inches). For each point in the spreadsheet a value for strength and softness was calculated from the regression models. The graph shown in FIG. 8 was then created plotting softness on one axis and strength on the other axis grouped by the roll diameter.

As shown in FIG. 8 the process of the present invention shifts the strength/softness curve towards creating softer and stronger webs. Further, decreasing the shear inducing roll diameter further increases the softness of the webs at a given strength.

During the experiments, it was also noticed that between 5% to 15% caliper reduction was obtained, without positively or negatively affecting any product attributes.

Figure 9:
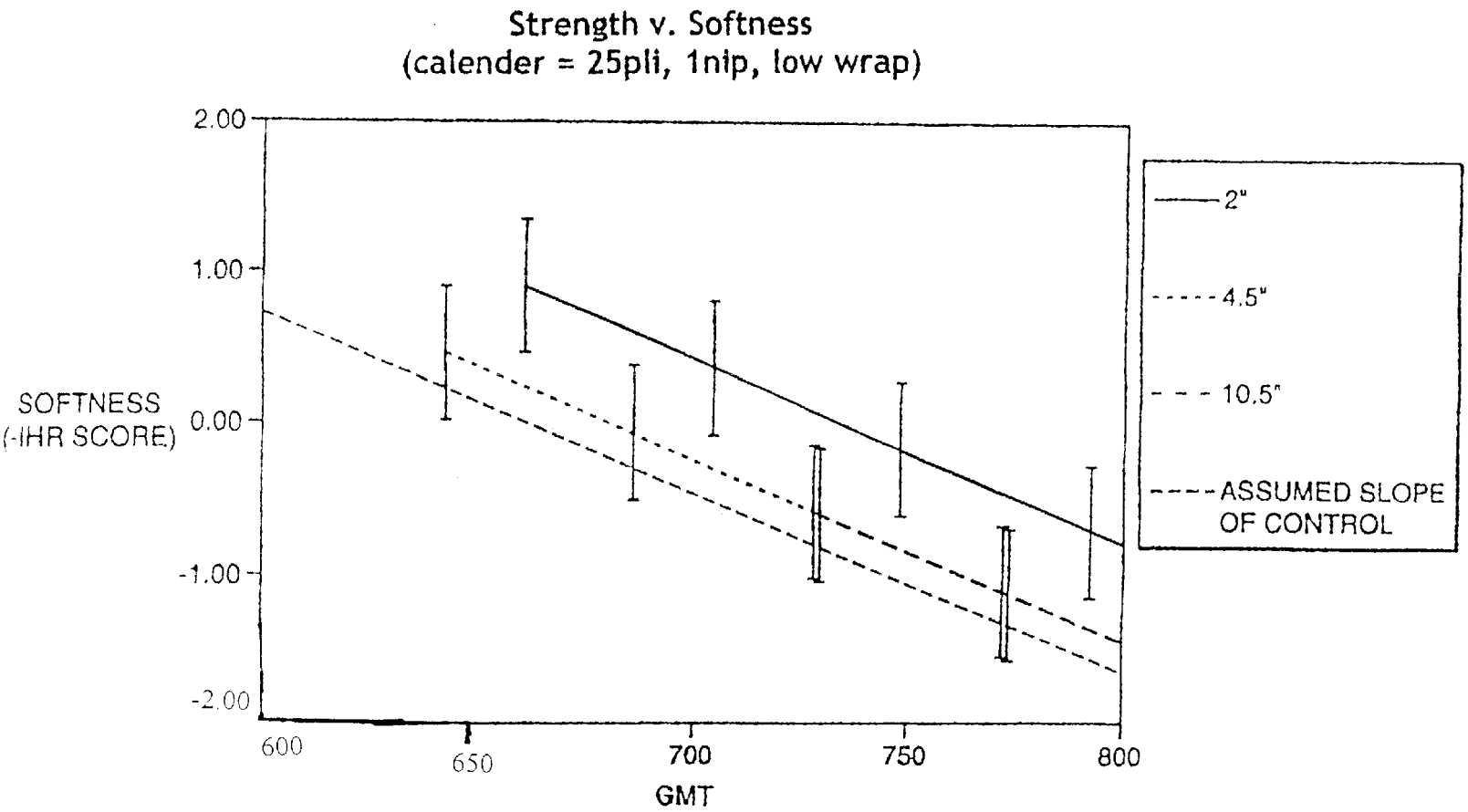

Using the mathematical models, another set of curves was generated from another set of experiments. Specifically, in this set of experiments, only a single shear inducing roll was used. The results are shown in FIG. 9.

As shown, a decrease in the diameter of the shear inducing roll had a greater impact upon the base webs in comparison to the control.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for reducing the caliper of a paper web comprising:

a first moving conveyor;

a second moving conveyor, said second moving conveyor overlapping said first moving conveyor along a predetermined distance, said first and second moving conveyors being configured to receive a base web in between said conveyors;

a first support roll and a second support roll located within said predetermined distance, said first and second moving conveyors being at least partially wrapped around said support rolls; and a shear inducing roll positioned in between said first support roll and said second support roll, said shear inducing roll contacting said first support roll and said second support roll thereby forming a first nip and a second nip respectively, said first and second moving conveyors being guided around said first support roll, through said first nip, around said shear inducing roll and through said second nip, said first and second nips having nip pressures sufficient to reduce the caliper of a base web positioned in between said moving conveyors.

2. A system as defined in claim 1, wherein said shear inducing roll has an axis defining an axial direction, said shear inducing roll being fixed only in said axial direction.

3. A system as defined in claim 1, wherein said first support roll has a first diameter, said second support roll has a second diameter, and said shear inducing roll has a third diameter, said first and second diameters being greater than said third diameter.

4. A system as defined in claim 3, wherein said first diameter is equal to said second diameter.

5. A system as defined in claim 1, wherein said shear inducing roll has a diameter of less than about 10 inches.

6. A system as defined in claim 1, wherein said first support roll includes an axis and said second support roll includes an axis, both said axes being located in a common plane, said shear inducing roll having an axis that is not located in said common plane.

7. A system as defined in claim 1, wherein said shear inducing roll has a diameter of between about two inches and about six inches.

8. A system as defined in claim 1, wherein said first and second moving conveyors are wrapped around said shear inducing roll in an amount greater than about 180°.

9. A system as defined in claim 1, wherein said first support roll has a first outer edge and said second support roll has a second outer edge, said first and second outer edges being separated by a distance of at least one inch.

10. A system as defined in claim 1, wherein said first and second support rolls have a diameter of at least 20 inches.

11. A system as defined in claim 1, wherein said first and second moving conveyors are under a tension, said tension holding said shear inducing roll in contact with said first and second support rolls.

12. A process for reducing the caliper of a web comprising:

forming a base web;

placing said base web in between a first moving conveyor and a second moving conveyor;

guiding said first and second moving conveyors around a first support roll and through a first nip, said first nip being formed between said first support roll and a shear inducing roll; and guiding said first and second moving conveyors through a second nip, said second nip being formed between said shear inducing roll and a second support roll, said shear inducing roll being positioned between said first support roll and said second support roll.

13. A process as defined in claim 12, wherein said shear inducing roll has an axis defining an axial direction, said shear inducing roll being fixed only in said axial direction.

14. A process as defined in claim 12, wherein said shear inducing roll has a diameter of less than about 10 inches.

15. A process as defined in claim 12, wherein said first and second support rolls have a diameter of at least about 20 inches.

16. A process as defined in claim 12, wherein said first and second moving conveyors are under a tension, said tension holding said shear inducing roll in contact with said first and second support rolls.

17. A process as defined in claim 12, wherein said base web contains pulp fibers.

18. A process as defined in claim 12, wherein said base web has a moisture content of less than about 5% by weight when guided around said shear inducing roll.

19. A process as defined in claim 12, wherein said base web comprises a stratified web.

20. A system for reducing the caliper of a base web, comprising:

a first moving conveyor;

a second moving conveyor, said second moving conveyor overlapping said first moving conveyor along a predetermined distance, said first and second moving conveyors being configured to receive a base web in between said conveyors;

a shear inducing roll having a diameter of less than about 10 inches, said first and second conveyors being wrapped around said shear inducing roll an amount sufficient to reduce the caliper of a base web located between said conveyors; and a bearing supporting said shear inducing roll, said bearing being in fluid communication with a gas source for creating a gas film upon which said shear inducing roll rotates.

21. A system as defined in claim 20, further comprising a stationary beam, said stationary beam comprising at least one gas chamber, said stationary beam supporting said bearing.

22. A system as defined in claim 21, wherein said stationary beam comprises two gas chambers.

23. A system as defined in claim 20, wherein said shear inducing roll has a diameter less than about 6 inches.

24. A system as defined in claim 20, wherein said bearing defines a concave surface for receiving said shear inducing roll, said concave surface including a first half and a second half, said bearing defining a plurality of fluid passages for creating said gas film which supports said shear inducing roll.

25. A system as defined in claim 24, further comprising a first pressure regulator in communication with the fluid passages located on said first half of said concave surface and a second pressure regulator in fluid communication with the fluid passages located on said second half of said concave surface, said first and second pressure regulators for controlling the gas pressure exerted on said shear inducing roll.

26. A system as defined in claim 20, wherein said first and second moving conveyors are wrapped around said shear inducing roll at least 40°.

* * * * *